US006151471A

United States Patent [19]

Yahata et al.

[11] Patent Number: 6,151,471

[45] Date of Patent: Nov. 21, 2000

[54] TONER SUPPLYING DEVICE, METHOD AND IMAGE FORMING APPARATUS USING THE SAME TONER SUPPLYING DEVICE OR METHOD

[75] Inventors: Masasumi Yahata, Kamakura; Shunji Katoh, Sagamihara; Yuuji Kitajima, Kawasaki, all of Japan

[73] Assignee: Ricoh Company, Ltd., Tokyo, Japan

[21] Appl. No.: 09/318,000

[22] Filed: May 25, 1999

[30] Foreign Application Priority Data

May 25, 1998 [JP] Japan ..... 10-159909
Jun. 3, 1998 [JP] Japan ..... 10-170613

[51] Int. Cl.[7] ..... G03G 15/08; G03G 21/10

[52] U.S. Cl. ..... 399/258; 399/27; 399/359

[58] Field of Search ..... 399/258, 256, 399/254, 262, 119, 120, 358, 359, 360, 24, 27

[56] References Cited

U.S. PATENT DOCUMENTS

| | | | |
|---|---|---|---|
| 3,816,157 | 6/1974 | Donohue et al. | 399/359 X |
| 4,384,785 | 5/1983 | Katoh et al. | 399/190 |
| 5,493,382 | 2/1996 | Takagaki et al. | 399/359 |
| 5,585,899 | 12/1996 | Palumbo et al. | 399/358 X |
| 5,604,575 | 2/1997 | Takagaki et al. | 399/359 |
| 5,734,957 | 3/1998 | Ogawa et al. | 399/359 |
| 5,737,680 | 4/1998 | Takagaki et al. | 399/359 |
| 5,909,609 | 6/1999 | Yahata et al. | 399/258 |
| 5,950,055 | 9/1999 | Yahata et al. | 399/359 X |
| 5,950,062 | 9/1999 | Yahata et al. | 399/358 |
| 5,960,246 | 9/1999 | Kasahara et al. | 399/359 |

FOREIGN PATENT DOCUMENTS

| | | |
|---|---|---|
| 2-277083 | 11/1990 | Japan . |
| 4-80779 | 3/1992 | Japan . |
| 5-293443 | 11/1993 | Japan . |
| 6-83189 | 3/1994 | Japan . |
| 7-77906 | 3/1995 | Japan . |
| 7-210050 | 8/1995 | Japan . |
| 7-219329 | 8/1995 | Japan . |
| 8-137227 | 5/1996 | Japan . |
| 9-274371 | 10/1997 | Japan . |
| 10-260583 | 9/1998 | Japan . |
| 10-293452 | 11/1998 | Japan . |

*Primary Examiner*—Robert Beatty
*Assistant Examiner*—Sophia S. Chen
*Attorney, Agent, or Firm*—Oblon, Spivak, McClelland, Maier & Neustadt, P.C.

[57] ABSTRACT

A toner supplying device for supplying toner contained in a toner container to a developing device of an image forming apparatus includes a toner container insertion part configured to receive at least two inserted toner containers from a front side of the toner supplying device. A toner container holder detachably holds the toner containers inserted into the toner container insertion part. A toner container selection control device selects an arbitrary toner container from among the at least two toner containers held by the toner container holder and causes the selected toner container to discharge toner from an opening thereof while stopping a discharge of toner from an opening of the other toner containers. Toner discharged from the opening of the toner container held by the toner container holder is exhausted to a toner conveying path, and a toner/air mixture delivery device delivers the toner exhausted to the toner conveying path to the developing device of the image forming apparatus by mixing the toner with air.

53 Claims, 25 Drawing Sheets

(20)
(t)
101
31
30
1a
25
21a
(T)
32
34
23
1
J
A
22
22a
22b
20a
24
28
26
104
102
103
108
104a
104b
100

TONER SUPPLYING DEVICE, METHOD AND IMAGE FORMING APPARATUS USING THE SAME TONER SUPPLYING DEVICE OR METHOD

BACKGROUND OF THE INVENTION

1. Field of the Invention

This invention relates generally to a toner supplying device included in an image forming apparatus and more particularly to a toner supplying device having two or more toner containers.

2. Discussion of the Background

In image forming devices using electrophotography, such as copying machines, facsimile devices and printers, a latent image is formed on a surface of a drum or belt-like shaped image bearing member by first uniformly charging the surface of the image bearing member and then exposing the charged surface with light which is modulated with image information. The latent image is then developed by a developing device to a visible toner image using a developer, such as, for example, a two component developer including toner and carrier. The developed toner image is transferred onto a recording medium such as a sheet of paper directly or via an intermediate transfer member, thereby forming an image on the sheet of paper.

The image forming devices of this type generally include a toner supplying device for supplying toner to the developing device as the developing device consumes the toner as it develops images. A toner container is attached to the toner supplying device. Once the toner is consumed by developing device, the image forming device generally stops the image forming operation and displays a message indicating that the toner container has run out of toner. The device returns to an operable state once the toner container is replaced with a new toner container and the toner is supplied to the developing device.

Various toner supplying devices, in which a toner container is attached, have been proposed. For example, Japanese Patent Laid-open Publication No. 2-277083 describes toner supplying device having a plurality of toner containers, which are disposed near a developing device. The toner container chosen to supply toner to the developing device is changed by rotating the toner supplying device.

Japanese Patent Laid-open Publication No. 7-219329 describes a toner supplying device, which is placed apart from a developing device to improve the maintenance operability of the toner supplying device. The toner supplying device is connected to the developing device via a toner delivery device which delivers toner by mixing the toner with air.

Further, Japanese Patent Laid-open Publications No. 4-80779 and No. 8-137227 describe a toner supplying device including a toner container accommodating device in which a plurality of toner containers can be attached. Toner discharged from each of the plurality of toner containers is merged together and conveyed to a developing device. Each of the plurality of toner containers is individually attachable to and detachable from the toner supplying device. Japanese Patent Laid-open Publication No. 8-137227 further describes that the toner container accommodating device accommodates two toner containers and when a sensor detects non-existence of toner in a toner conveying pipe to a developing device, an agitator of one of the two toner containers which has not been operated, begins to rotate to supply toner therefrom.

Furthermore, the present inventors have proposed a toner supplying device which includes a plurality of toner containers and which is disposed in a position apart from a developing device. Toner is conveyed to the developing device from the toner supplying device via a toner conveying device connecting the developing device and the toner supplying device.

The toner supplying devices including a plurality of toner containers, which are described in the prior art, have a problem that the operability of attaching and detaching a toner container to and from the toner supplying device is poor. Further, even if the toner supplying device is configured such that another toner container starts to discharge toner immediately before or when the operating toner container becomes empty, selecting an optional toner container among from a plurality of toner containers, which are attached to the toner supplying device, before the operating toner container becomes almost empty or completely empty, is not possible. If a toner container, which is operated to discharge toner following the operating toner container, is empty, an intermittent supply of toner to a developing device occurs and a decrease in the volume or density of the toner is caused in the developing device. Consequently, the resulting image quality is deteriorated. Stoppage of the image forming operation may also occur. Further, if a toner container is kept unoperated for a long time after having been attached to the toner supplying device, the toner in the container deteriorates, and the resulting image quality may be deteriorated.

The image forming devices as described above typically further include a cleaning device that removes residual toner remaining on the photoconductor or the intermediate transfer member to prevent contamination of subsequent images which will be formed thereupon. The image forming devices also include a cleaning device that removes toner remaining on the transfer belt and a conveying belt which conveys a transfer sheet to the fixing unit. Residual toner collected by the cleaning devices is generally put into a discardable toner container, i.e., a toner container for storing discardable toner, and is disposed of by a service person or a user of the apparatus.

Recently, demands for recycling residual used toner, which is collected by cleaning devices of an image forming apparatus, have increased, and mechanisms for conveying collected used toner to a developing device of the apparatus or to a toner supplying device that supplies toner to the developing device have been proposed.

Residual used toner collected by cleaning devices generally includes paper dust, which is produced from a transfer sheet. Paper dust is produced, for example, when the transfer sheet passes between the transfer device and the photoconductor or the intermediate transfer member. The residual used toner also includes coagulated toner particles which are larger than unused toner particles. If the residual used toner is recycled for image formation, paper dust and/or coagulated toner particles included therein may form abnormal toner images. For example, white spots may be formed in a part of a toner image formed by toner which includes paper dust. A part of a toner image formed by toner which includes a large coagulated toner particle may be blurred.

To solve such problems, Japanese Patent Laid-open Publication No. 7-77906 proposes to provide a filter for removing paper dust and coagulated toner particles from the collected used toner so that only reusable used toner separated from non-reusable used toner is recycled to the toner supplying device.

Further, as related art, Japanese Patent Laid-open Publication No. 5-293443 describes a technology to remove large toner particles with a screen at the last stage of a process of manufacturing toner for image forming devices.

Image forming devices including such a toner supplying device having a plurality of toner containers and a mechanism for recycling residual used toner collected by cleaning devices to a developing device or to a toner supplying device as described above have a problem that a toner container containing new toner, a container containing reusable used toner and a container containing non-reusable used toner are separately located in the apparatus and thereby scattering of toner and consequent soiling with scattered toner occurs in various parts of the image forming devices. In addition, the operability of attaching and detaching respective toner containers is poor.

SUMMARY OF THE INVENTION

The present invention has been made in view of the above-discussed problems. An object of the invention is to address and resolve these and other problems. A non-exhaustive description of the features and attributes of the invention is presented in this section, with a more complete description provided by the figures and description of the preferred embodiment section of this document.

A feature of the present invention is a novel toner supplying device and a method for supplying toner to a developing device of an image forming device and an image forming device using the same toner supplying device or method, in which the operability of attaching and detaching a toner container to and from the toner supplying device is improved and in which an optional selection of a toner container for a next operation from among an attached plurality of toner containers is possible, so that an intermittent supply of toner to the developing device and/or deterioration of toner in a toner container are prevented and thereby consequent deterioration of the resulting image quality is prevented.

The present invention further provides a novel toner supplying device and method for supplying toner to a developing device of an image forming device and an image forming device using the same toner supplying device or method, in which the operability of attaching and detaching a toner container to and from the toner supplying device is improved and in which coagulation of toner and/or scattering of toner and consequent soiling with scattered toner are prevented.

According to the present invention, a toner supplying device for supplying toner contained in a toner container to a developing device of an image forming apparatus includes a toner container insertion part configured to receive at least two inserted toner containers from a front side of the toner supplying device. A toner container holder detachably holds the toner containers inserted into the toner container insertion part. A toner container selection control device selects an arbitrary toner container from among the at least two toner containers held by the toner container holder and causes the selected toner container to discharge toner from an opening thereof while stopping a discharge of toner from an opening of the other toner containers. Toner discharged from the opening of the selected toner container held by the toner container holder is exhausted to a toner conveying path, and a toner/air mixture delivery device delivers the toner exhausted to the toner conveying path to the developing device of the image forming apparatus by mixing the toner with air.

The toner container selection control device may cause only the selected toner container to discharge toner from the opening thereof when all of the at least two toner containers are in an initial state.

According to the invention, the toner container selection control device may continue to operate the toner container, which has been once started to discharge toner, to discharge toner until the toner container becomes almost empty or empty, while stopping the other toner containers to discharge toner from their respective openings.

Alternatively, the toner container selection control device may start to operate another toner container to discharge toner from an opening thereof after the toner container, which has been once started to discharge toner, becomes almost empty or empty.

Furthermore, the toner container selection control device may stop discharging toner from an opening of the toner container, which has been once started to discharge toner, before the toner container becomes almost empty or empty and starts operating another toner container to discharge toner from an opening thereof.

Further, when all of the at least two toner containers, which are held by the toner container holder, become almost empty or empty, the toner container selection control device may cause a toner near-end indicating device to indicate that the toner containers in the toner supplying devices are almost empty or empty.

According to the present invention, the above toner supplying device may further include a used toner intake inlet to receive used toner, which is collected after having been used for image formation, and a collected used toner accommodating device to accommodate collected used toner, which is received through the used toner intake inlet.

The toner supplying device may further include a used toner sorting device that sorts the used toner, which is received through the used toner intake inlet, into reusable used toner and non-reusable used toner.

The used toner sorting device may be positioned at a side of the opening of the toner containers inserted in the toner container insertion part.

The toner supplying device may further include a merging part where the toner conveying path, to which the toner discharged from the toner containers held by the toner container holder is exhausted, and a reusable used toner conveying path, to which reusable used toner sorted by the used toner sorting device is exhausted, are merged. The reusable used toner conveying path may be positioned at the side of the opening of the toner containers inserted into the toner container insertion part.

The toner supplying device may further include a discarding toner conveying path to which non-reusable used toner, which is sorted by the used toner sorting device, is exhausted. The discarding toner conveying path may be positioned at the side of the opening of the toner containers inserted into the toner container insertion part.

The collected used toner accommodating device may include a discarding toner container, into which the non-reusable used toner is put, and a discarding toner container insertion part, into which the discarding toner container is inserted from the front side of the toner supplying device.

The toner supplying device may further include an attaching device to detachably attach the toner supplying device to the image forming device.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
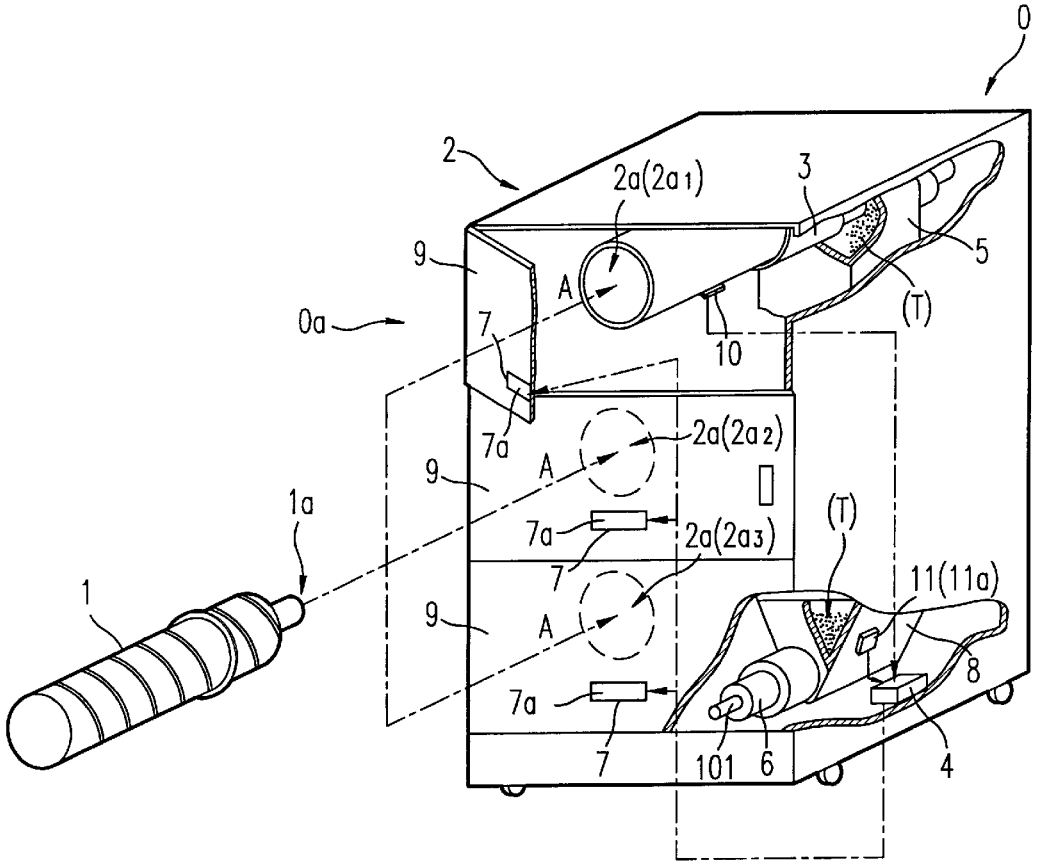
FIG. 1 is a schematic drawing illustrating a toner supplying device according to an embodiment of the present invention.

Referring now to the drawings, wherein like reference numerals designate identical or corresponding parts throughout the several views, and more particularly to FIG. 1 thereof, there is illustrated a toner supplying device according to an embodiment of the present invention.

A toner supplying device 0 is configured such that a plurality of toner containers 1, which are formed in a substantially cylindrical shape, each containing toner (T) for developing a latent image in electrophotography, can be inserted and attached thereto. Each of the toner containers 1 is inserted into a toner container insertion part 2 from the front surface 0*a* of the toner supplying device 0. The toner containers 1 are inserted in a direction indicated by an arrow A in the drawing into respective toner container insertion inlets 2*a*1, 2*a*2 and 2*a*3 and are detachably held by respective toner container holders 3.

A CPU of a toner container selection control device 4 optionally selects a toner container 1 from among two or more than two toner containers 1 which are held by the toner container holders 3 and causes the selected toner container 1 to discharge toner therefrom through an opening 1*a*, which is provided at an axial end of the container 1 in the direction in which the container 1 is inserted into the toner container insertion part 2, by rotating the selected toner container 1 with a rotation drive device (not shown). The CPU of the toner container selection control device 4 also controls the toner containers 1 other than the selected one not to discharge toner from the opening 1*a*. The discharged toner is exhausted to a toner exhausting path 5 provided at a rear side of the toner container insertion part 2. The toner exhausted to the toner exhausting path 5 from each toner container 1 is conveyed to a toner deposit part 8 at the bottom of the toner exhausting path 5. The toner deposited in the toner deposit part 8 is then mixed with air by a toner delivery device 6 using a so-called Moineau pump and is conveyed via a toner/air mixture conveying path 101, which may be made of a flexible pipe, to a developing device of an image forming device (not shown) to which the toner supplying device 0 is attached.

A toner near-end indicating device 7 is provided on each of the open/close covers 9 which are arranged so as to cover and uncover the toner container insertion inlets 2*a*1, 2*a*2 and 2*a*3. When all of the two or more toner containers 1 which are held by the holders 3 become empty or almost empty, the toner near-end indicating device 7 indicates that all of the toner containers 1 have become almost empty or empty in an indicator plane 7*a* of the toner near-end indicating device 7 under the control of the CPU of the toner container selection control device 4.

The indicator plane 7*a* includes a display device, such as for example, an LED display device, and displays a message indicating that all of the toner containers 1 have become almost empty or empty. The message may be displayed alone or maybe accompanied by a reminding sound.

A toner container detect device 10 is arranged in each of the toner container insertion inlets 2*a*1, 2*a*2, 2*a*3, so as to detect the existence of the toner container 1 inserted into each of the toner container insertion inlets 2*a*1, 2*a*2, 2*a*3 and held by the corresponding toner container holder 3.

A toner detect device 11 is arranged in the toner deposit part 8 to detect the existence of toner in the toner deposit part 8. The toner detect device 11 includes, for example, a sensor 11*a* that detects if the deposited toner in the toner deposit part 8 exceeds a predetermined height. The CPU of the toner container selection control device 4 determines, based upon the detected result with the toner detect device 11, if all of the toner containers 1 are almost empty or empty.

Figure 2:
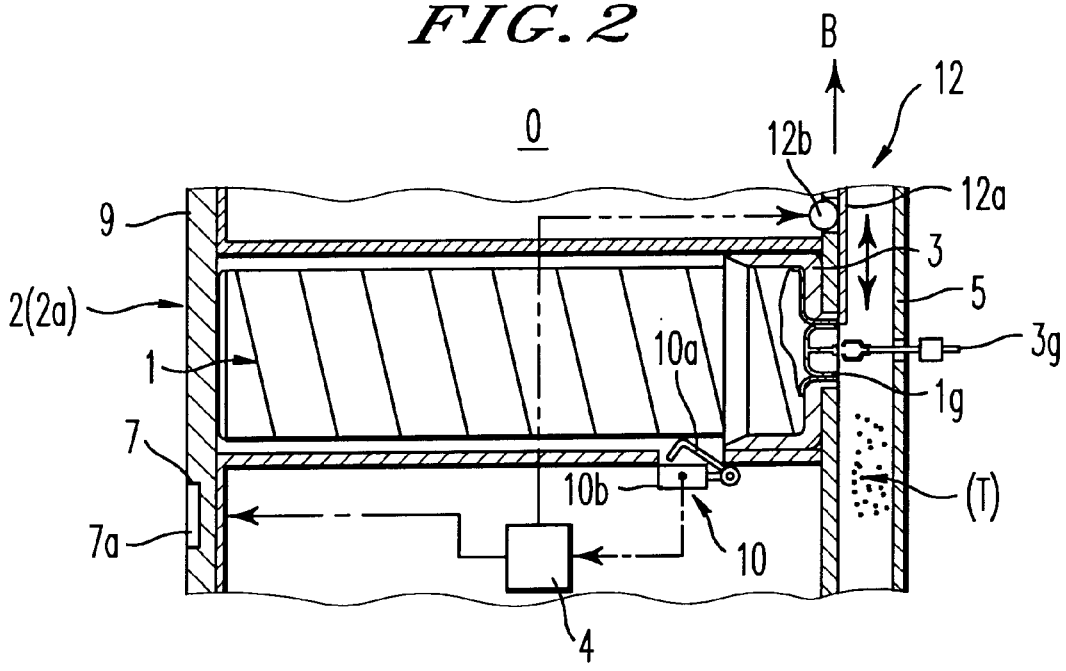
FIG. 2 is a schematic drawing illustrating a sectional view of the main part of the toner supplying device of FIG. 1.

FIG. 2 is a schematic drawing illustrating a sectional view of a main part of the toner supplying device 0. As illustrated in the drawing, when the toner container 1 is inserted into the toner container insertion inlet 2*a* of the toner container insertion part 2 and is held by the toner container holder 3, a feeler 10*a* of the toner container detect device 10 contacts a sensor 10*b*, such as for example, a photo-interrupter, and thereby the existence of the toner container 1 is detected.

When the toner container detect device 10 detects a toner container 1, a shutter plate 12*a* of a shutter 12 is driven by a drive motor 12*b* (or a driving device including a gear and an arm, which are driven by a motor) to move in a direction indicated by an arrow B to open the communication between the toner container insertion inlet 2*a* and the toner conveying path 5. A moving device 3*g* of the toner container holder 3 removes a cap 1*g* from the opening 1*a* of the toner container 1, so that toner can be exhausted to the toner conveying path 5 from the opening 1*a* of the toner container 1.

Figure 3:
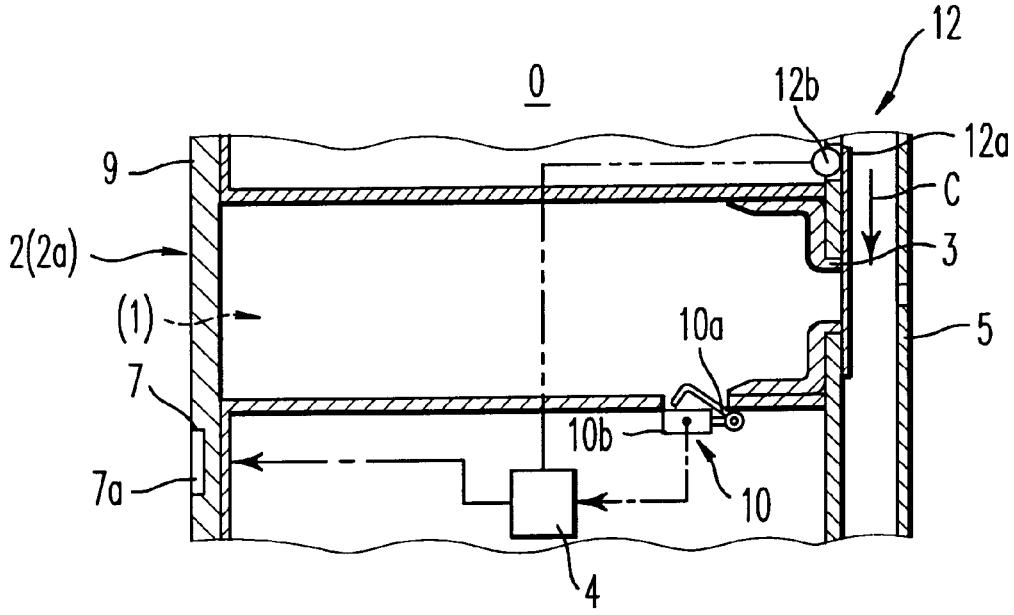
FIG. 3 is a schematic drawing illustrating a sectional view of the main part of the toner supplying device when a toner container is not inserted in the toner insertion part.

FIG. 3 is a schematic drawing illustrating a sectional view of the main part of the toner supplying device 0 when a toner container 1 is not inserted in the toner container insertion part 2. When the toner container 1 is not inserted in the toner container insertion inlet 2*a*, the feeler 10*a* of the toner container detect device 10 is rotated in a counterclockwise direction, such that the feeler 10*a* does not interfere with the sensor 10*b*, and thereby it is detected that no toner container 1 exists.

When the toner container detect device 10 detects no toner container 1, the shutter plate 12*a* of the shutter 12 is driven by the drive motor 12*b* to move in a direction indicated by an arrow C to close the communication between the toner container insertion inlet 2*a* and the toner conveying path 5, such that scattering of toner into the toner container insertion inlet 2*a* from the toner conveying path 5 is prevented.

Figure 4A:
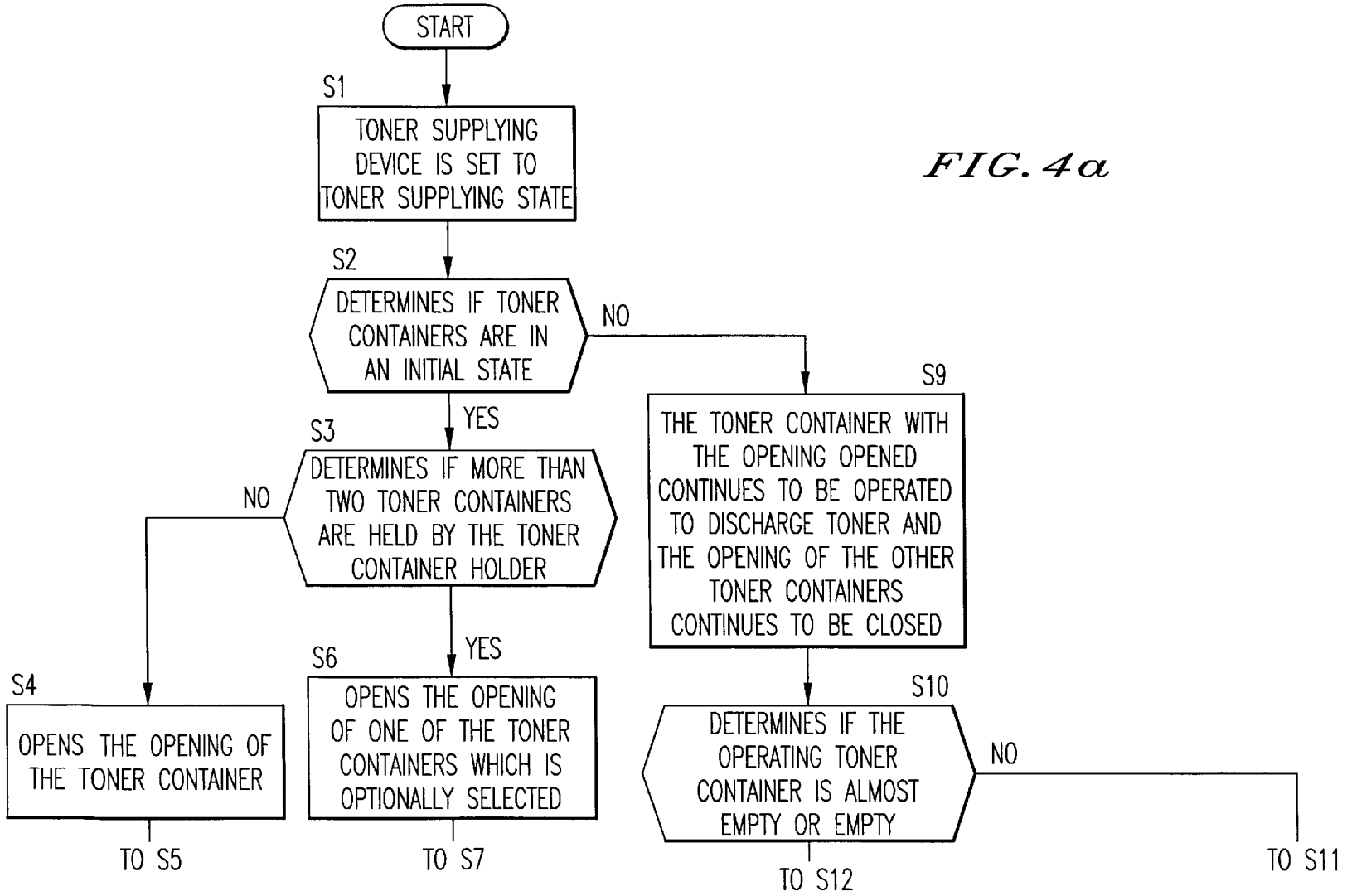
FIG. 4 is a flowchart of an exemplary control operation of the toner supplying device for controlling the toner supplying device such that a toner container, which is once started to be operated to discharge toner, is continued to be operated until the toner container becomes almost empty or empty.
Figure 4B:
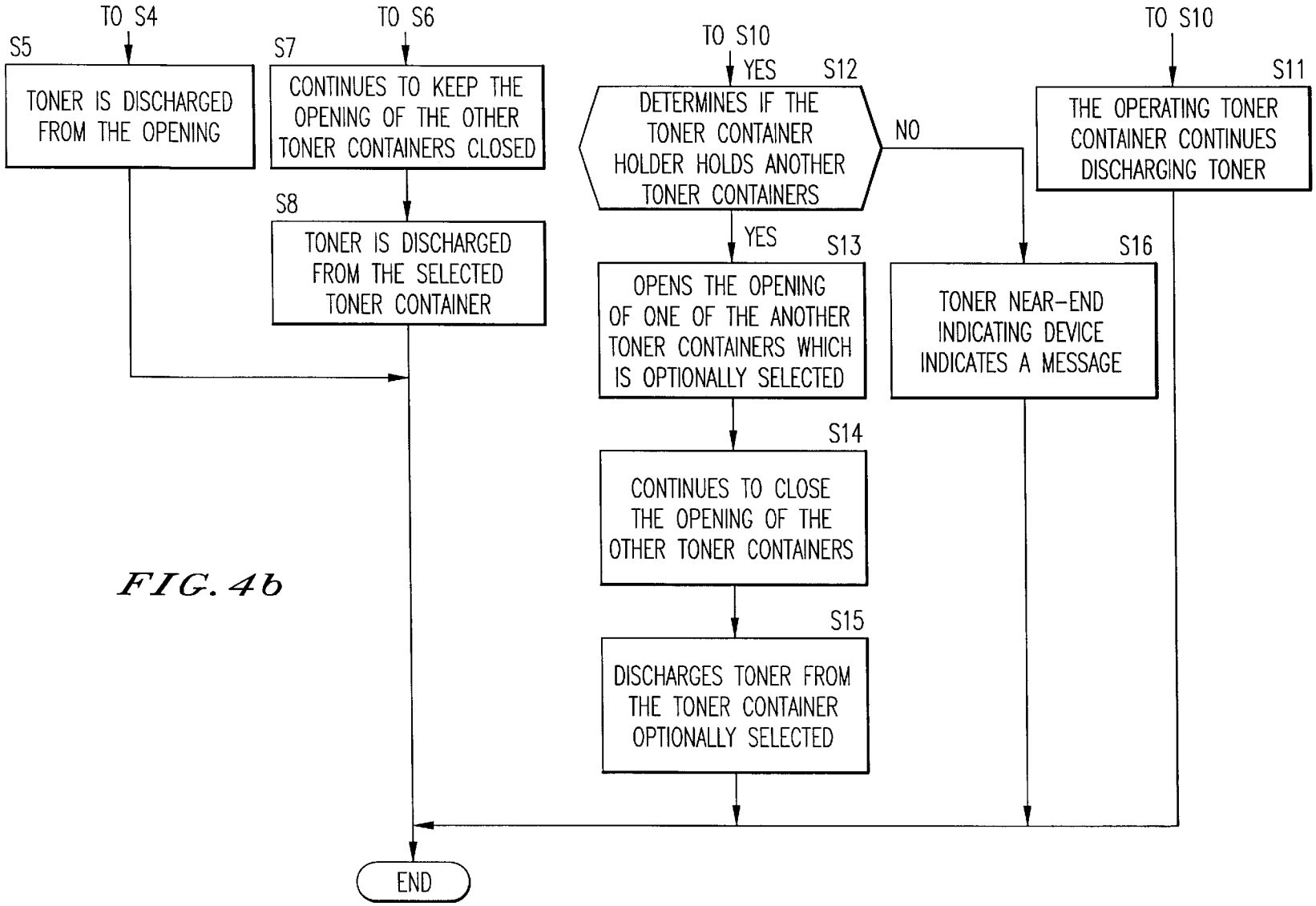

FIG. 4 is a flowchart of an exemplary operation for controlling the toner supplying device 0, under control of the CPU of the toner container selection control device 4, such that a toner container 1 which once starts to discharge toner continues to be operated until the toner container 1 becomes almost empty or empty.

In step S1, the toner supplying device 0 is set to a toner supplying state. Step S2 determines if all of the toner containers 1 inserted into the toner container insertion inlets 2*a*1, 2*a*2, 2*a*3 are in an initial state, i.e., new and have not been operated before. If all of the toner containers 1 are in the initial state, step S3 determines if two or more toner containers 1 are held by the toner container holder 3 by the toner container detect device 10. When there is only one toner container 1 held, step S4 opens the opening 1*a* of the toner container 1 by taking off the cap 1*g*, and toner is discharged from the opening 1*a* in step S5.

When two or more toner containers 1 are held by the toner container holder 3 in step S3, step S6 opens the opening 1*a* of one of the toner containers 1, which is optionally selected, by taking off the cap 1*g*, and step S7 continues to keep the opening 1*a* of the other toner containers 1 closed by the cap 1*g*. Then, in step S8, toner is discharged from the selected toner container 1.

When all of the toner containers 1 inserted into the toner container insertion inlets 2*a*1, 2*a*2, 2*a*3 are not in an initial state, i.e., not new, in step S2, then in step S9, the toner container 1, which has been opened to discharge toner from the opening 1*a*, continues to discharge toner and the opening 1*a* of the other toner containers 1 continues to be closed with the cap 1*g*. Then, step S10 determines if the operating toner container 1 is almost empty or empty with the sensor 11*a* of the toner detect device 11. When the operating toner container 1 is not almost empty or empty, step S11 continues to discharge toner from the operating toner container 1. When the operating toner container 1 is almost empty or empty in step S10, step S12 determines if the toner container holder 3 holds another toner container 1 with the toner container detect device 10. When the toner container holder 3 holds another toner container 1, step S13 opens one of the other toner containers 1, which is optionally selected, by taking off the cap 1*g*, and step S14 continues to close the other toner containers 1 with cap 1*g*. Step S15 discharges toner from the optionally selected toner container 1. When the toner container holder 3 does not hold another toner container 1 in step S12, step S16 activates the toner near-end indicating device 7 to indicate a message indicating that all of the toner containers 1 are almost empty or empty.

Thus, in this example, when the toner supplying device 0 is in an initial state of an initial operation where all of the toner containers 1 attached to the toner supplying device 0 are new, the toner container selection control device 4 optionally selects a toner container 1 from among two or more toner containers 1 which are attached to the toner supplying device 0 and discharges toner only from the opening 1*a* of the selected toner container 1, while preventing the other toner containers 1, which are not selected, from discharging toner. Namely, once one toner container 1 starts to discharge toner, the other toner containers 1 are kept fully filled with toner. Thus, in the toner supplying device according to the present invention, when the operating toner container 1 becomes almost empty or empty and another toner container 1 is selected to be operated to discharge toner, a stoppage of toner supply to the developing device is prevented.

Figure 5A:
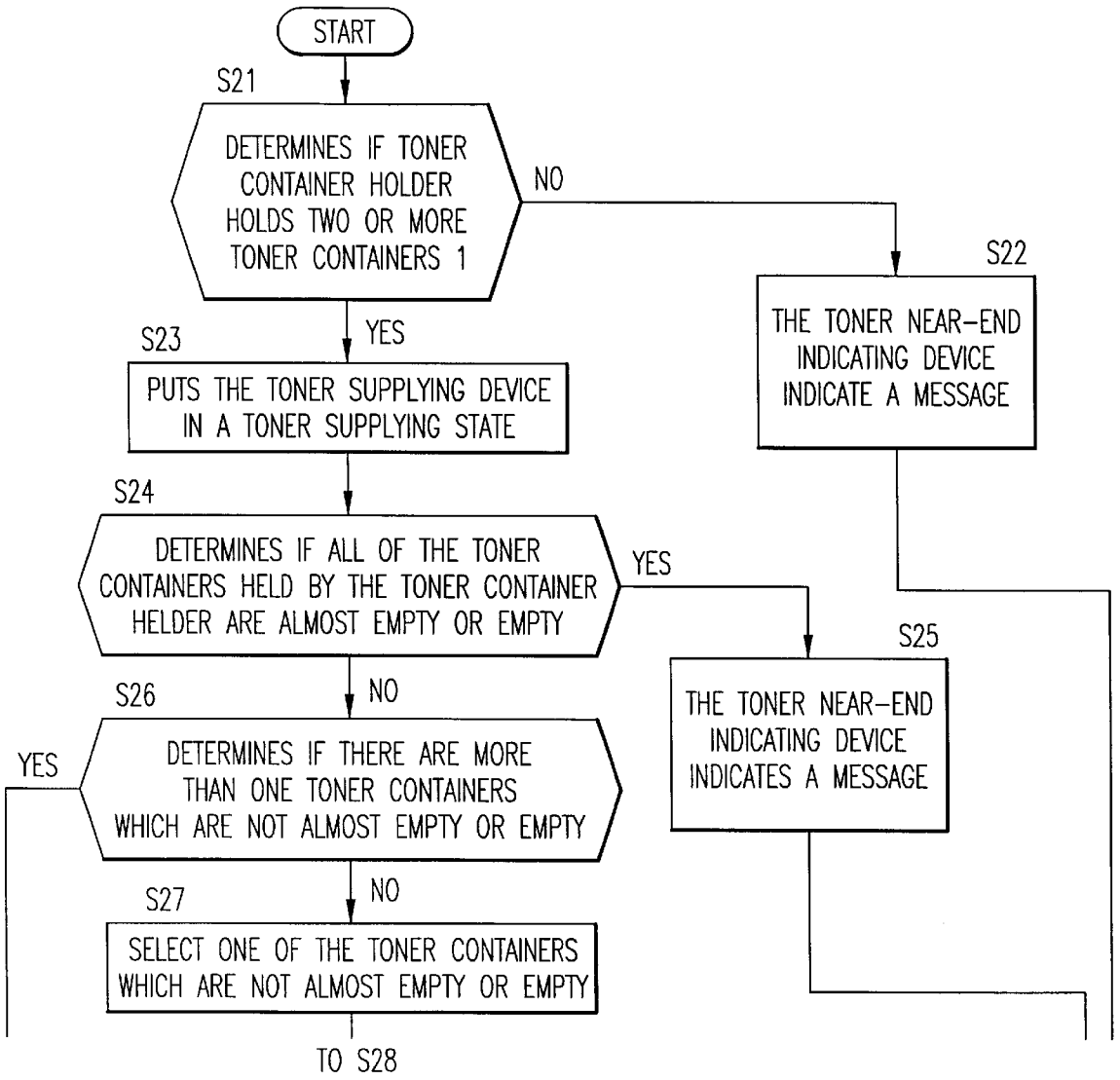
FIG. 5 is a flowchart of an exemplary control operation of the toner supplying device for controlling the toner supplying device such that the toner container, which is once started to be operated to discharge toner, is stopped to discharge toner before the toner container becomes almost empty or empty and another toner container starts to discharge toner.
Figure 5B:
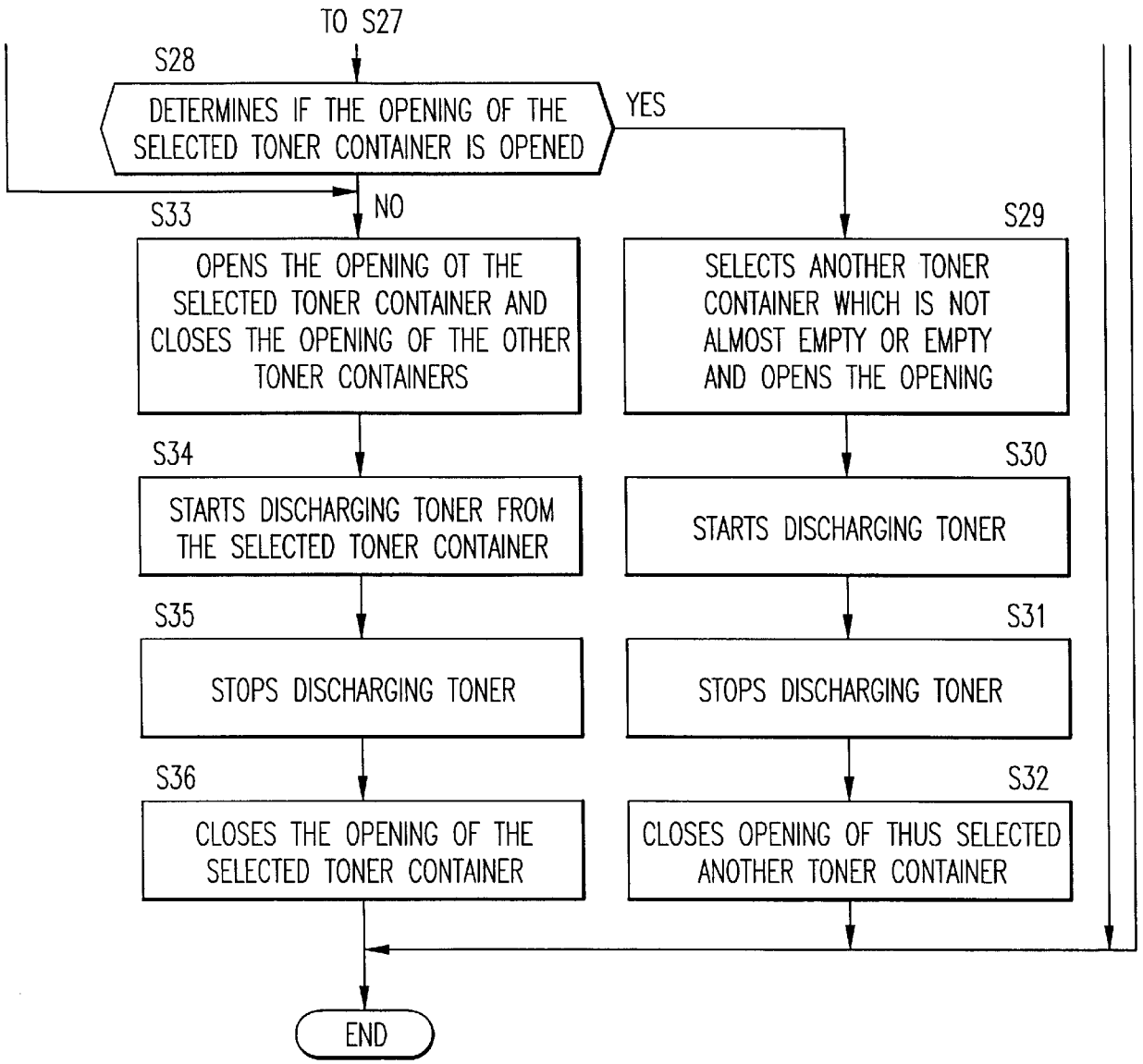

FIG. 5 is a flowchart of another exemplary operation for controlling the toner supplying device 0, under control of the CPU of the toner container selection control device 4, such that the toner container 1, which once starts to be operated to discharge toner, is stopped before the toner container 1 becomes almost empty or empty and another toner container 1 starts to discharge toner.

Step S21 determines if the toner container holder 3 holds two or more toner containers 1 with the toner container detect device 10. When the toner container holder 3 does not hold two or more toner containers 1, step S22 activates the toner near-end indicating device 7 to indicate a message that there is only one toner container 1 held by the toner container holder 3. When the toner container holder 3 holds two or more toner containers 1, step S23 puts the toner supplying device 0 in a toner supplying state. Step S24 then determines if all of the toner containers 1 held by the toner container holder 3 are almost empty or empty with the toner detect device 11. When all of the toner containers 1 are almost empty or empty, step S25 activates the toner near-end indicating device 7 to indicate a message that all of the toner containers 1 are almost empty or empty.

When all of the toner containers 1 are not almost empty or empty in step S24, step S26 determines if there are more than one toner containers 1 which are not almost empty or empty. When there is only one toner container 1 in step S26, the process proceeds to step S33. When there are more than one toner containers in step S26, then step S27 selects one of the toner containers 1 which are not almost empty or empty. Step S28 determines if the opening 1*a* of the selected toner container 1 is being opened to discharge toner. When the opening 1*a* of the selected toner container toner 1 is being opened to discharge toner, step S29 selects another toner container 1 which is not almost empty or empty and opens the opening 1*a* by taking off the cap 1*g*. Step S30 then starts discharging toner. Step S31 stops discharging toner and step S32 closes the opening 1*a* of thus selected another toner container 1.

When the opening of the selected toner container 1 is not being opened to discharge toner in step S28, step S33 opens the selected toner container 1 by taking off the cap 1*g* and closes the opening 1*a* of the other toner containers 1. Step S34 starts to discharge toner from the toner container 1 thus selected. Step S35 stops discharging toner and step S36 closes the opening 1*a* of the toner container 1 by putting on the cap 1*g*.

When there is only one toner container 1 which is not almost empty or empty in step S26, the process proceeds to step S33, where the opening 1*a* of such toner container 1 is opened.

Figure 6:
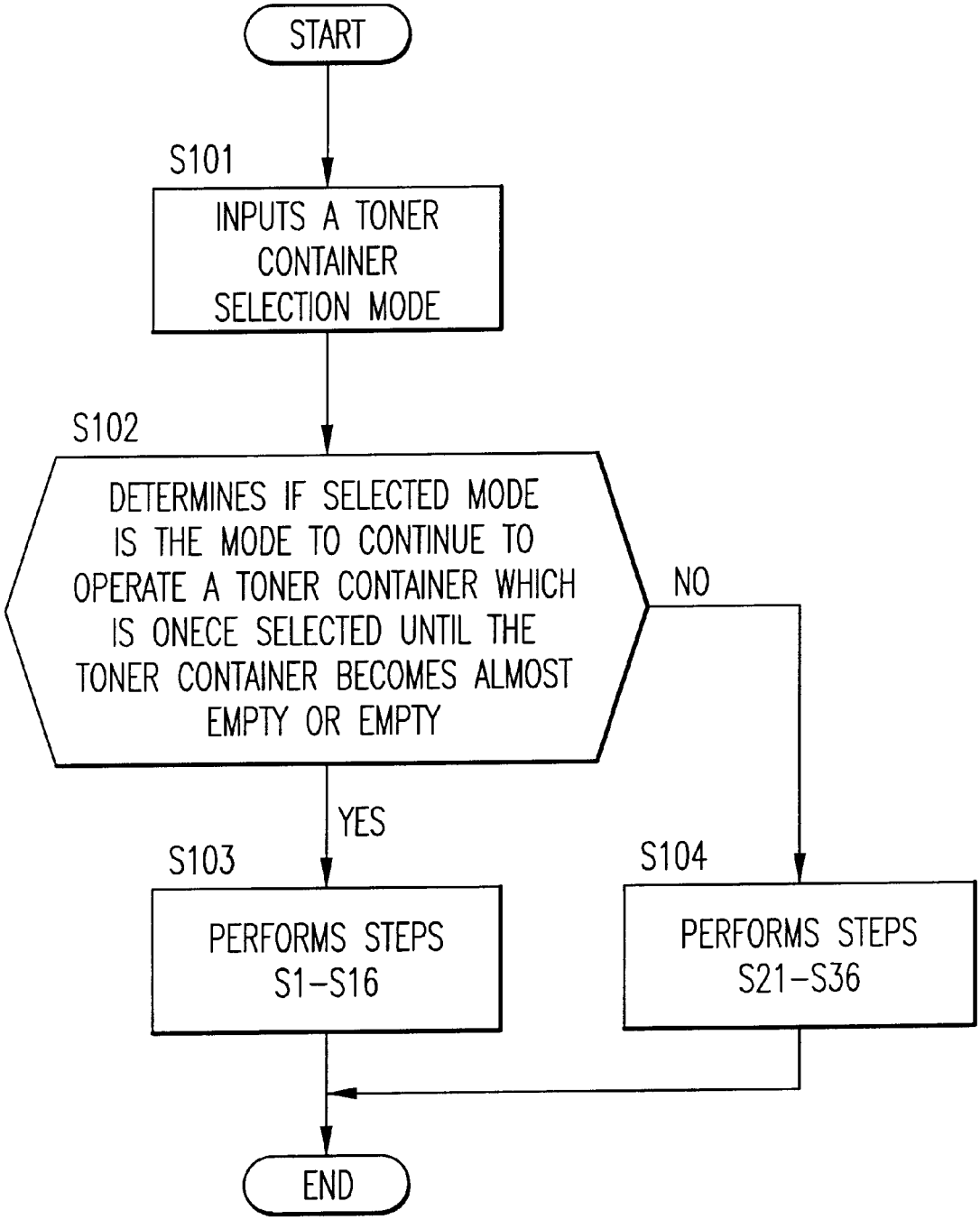
FIG. 6 is a flowchart of another exemplary operation of the toner supplying device for selecting a toner container via selection of a toner container selection mode.

FIG. 6 is a flowchart of another exemplary operation of the toner supplying device 0, in which a toner container selection mode is selected. Step S101 inputs a selected toner container selection mode via an input part (not shown) by manipulating keys. Step S102 determines if the selected mode is the mode to continue to operate a toner container 1 once it is selected to be operated, to discharge toner until the toner container 1 becomes almost empty or empty. When the selected mode is the one to continue to operate a toner container 1 until the container 1 becomes almost empty or empty, step S103 performs the operations of the above steps S1–S16, such that another toner container 1 is selected so as to be operated to discharge toner after the selected and operating toner container 1 becomes almost empty or empty.

When the selected mode is not the mode to continue to operate a selected and operating toner container 1 until the container 1 becomes almost empty or empty, step S104 performs the operations of the above steps S21–S36, such that another toner container 1 is selected and operated before the operating toner container 1 becomes almost empty or empty.

As described above, in the toner supplying device 0 according to the present invention, once a toner container 1 starts to be operated to discharge toner, the container 1 continues to be operated until the container 1 becomes almost empty or empty while the other toner containers 1 do not discharge toner. Therefore, the toner supplying device 0 always has a toner container 1 which is fully filled with toner, and thereby toner supply will not be interrupted or become low.

Further, because another toner container 1 starts to discharge toner after the operating toner container 1 becomes almost empty or empty, the toner will not remain in the toner container 1.

Furthermore, by stopping the operation of discharging toner before the toner container 1 becomes almost empty or empty and starting another toner container 1 to discharge toner by rotation thereof, the charge level of the toner in the another toner container 1, which starts discharging toner, decreases and thereby coagulation of the toner is prevented by rotation thereof. Accordingly, toner will be smoothly discharged from the opening 1*a* of the toner container 1, and consequently, toner supply will not be interrupted or become low.

Figure 7:
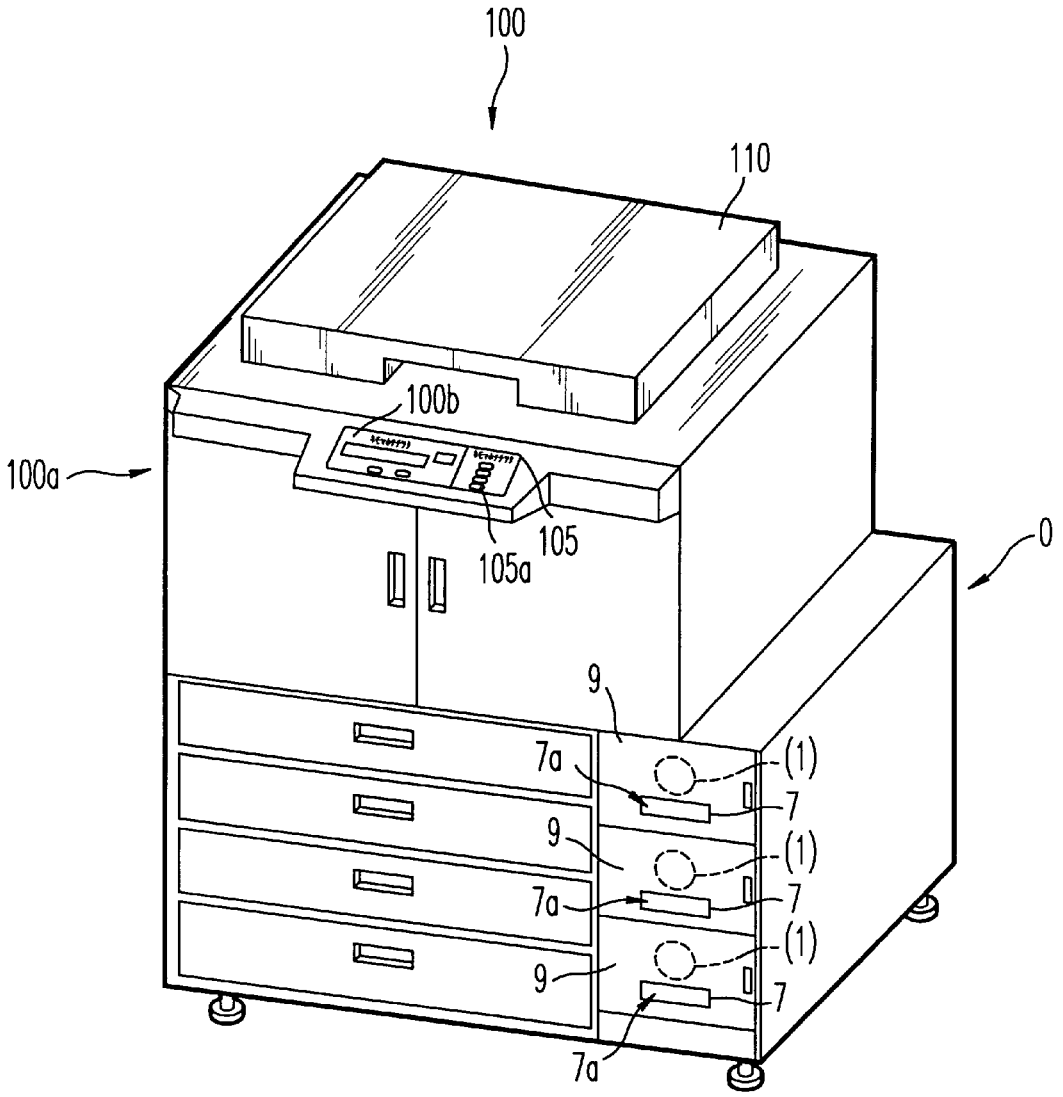
FIG. 7 is a schematic drawing illustrating an example of an outer appearance of an image forming apparatus including a toner supplying device according to the present invention.
Figure 8:
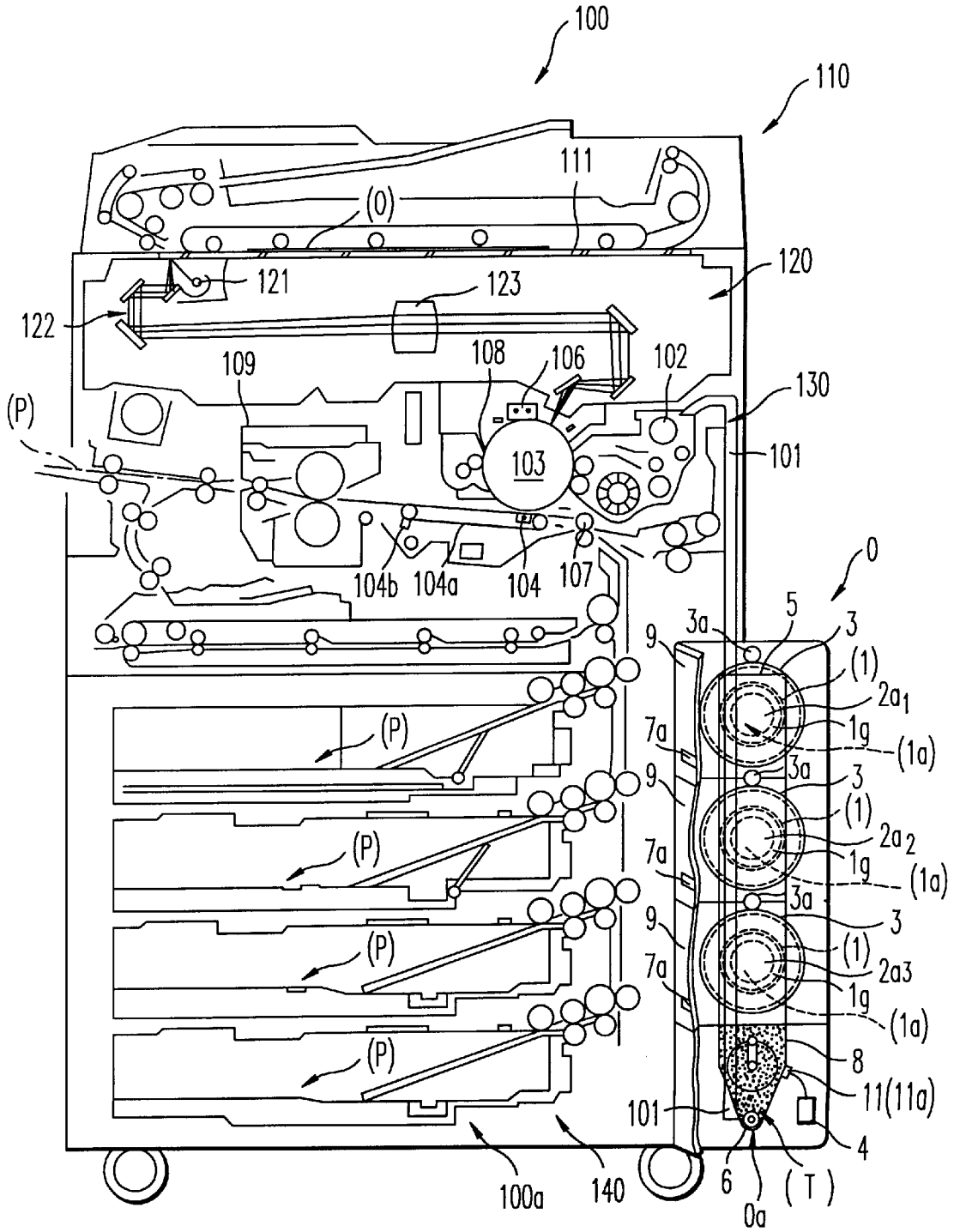
FIG. 8 is a sectional drawing illustrating an exemplary construction of the image forming apparatus.

FIG. 7 is a schematic drawing illustrating an example of an outer appearance of an image forming apparatus, including a toner supplying device according to the present invention, and FIG. 8 is a sectional drawing illustrating an exemplary construction of the image forming apparatus. As illustrated in the drawings, an image forming apparatus 100 includes the toner supplying device 0 at a lower right part of the image forming apparatus 100.

In FIG. 8, a main motor (not shown) is turned on and a toner container 1 held by the toner container holder 3 starts to be rotated by a rotation drive device 3*a*, toner (T) contained in the toner container 1 is exhausted through an opening 1*a*, which is provided at an axial end of the container 1, into a toner exhausting path 5. The toner exhausted to the toner exhausting path 5 from each toner container 1 is conveyed to a toner deposit part 8 at the bottom of the toner exhausting path 5. The toner deposited in the toner deposit part 8 is mixed with air by a toner delivery device 6 and is then conveyed to a developing device 102 of the image forming apparatus 100.

The supply of toner to the toner deposit part 8 is controlled by the sensor 11*a* of the toner detect device 11 provided at a bottom part of the toner deposit part 8 and the CPU of the toner container selection control device 4. Specifically, when the sensor 11*a* detects that the toner in the toner deposit part 8 is below a predetermined height, the operating toner container 1 is rotated to discharge toner through the opening 1*a* under a control of the CPU of the toner container selection control device 4 according to a detect signal from the sensor 11*a*. When the sensor 11*a* detects that the toner in the toner deposit part 8 is above the predetermined height, the toner container 1 is stopped.

When all of the toner containers 1 held by the toner container holder 3 become almost empty or empty, the CPU of the toner container selection control device 4 displays a message, with or without an accompanying sound, indicating that all of the toner containers 1 are almost empty or empty in the display plane 7*a* of the toner near-end indicating device 7, which is provided on the front surface of the open/close covers 9. The message is also displayed in a display plane 105*a* of a toner near-end indicating device 105, which is provided on an operation panel 100*b* provided on the front surface 100*a* of the image forming apparatus 100.

When the sensor 11*a* detects that the toner in the toner deposit part 8 is below the predetermined height a predetermined number of times or for a predetermined period of time, the CPU of the toner container selection control device 4 determines that the operating toner container 1 is almost empty. Then, the control device 4 closes the opening 1*a* of the operating toner container 1 with the cap 1*g*, after a predetermined period of time, which is sufficiently long for discharging the toner remaining in the toner container 1, elapses after the CPU of the toner container selection control device 4 determines that the operating toner container 1 is almost empty.

The image forming apparatus 100 is a copying machine and includes, in addition to the toner supplying device 0, an automatic document feeder (ADF) 110, an exposing section 120 for forming an image in a conventional known electrophotographic system, an image forming section 130, and a paper feeding section 140. The exposing section 120 has an exposure optical system including a light source 121 for putting light on a document (O) placed on a contact glass 111 by the ADF 110 or with a manual insertion, a series of mirrors 122 and a lens 123 for using a reflected light image from the document to expose a surface of a photosensitive drum 103, which is an image carrier of the image forming section 130.

The image forming section 130 has the photosensitive drum 103 as the image carrier, and a charging device 106, a developing device 102, a resist roller 107, a transfer device 104 and a photosensitive body cleaning device 108, which are arranged around the photosensitive drum 103. Also included is a fixing device 109. A plurality of paper feed cassettes are located in paper feed section 140, containing transfer paper (P) in various sizes. Although the above exposing section 120 is an example of an analog-type exposure optical system in the above image forming apparatus 100, if it is configured in a system in which an image is optically recorded on the photosensitive drum 103 based on an image signal by using a laser scan optical system in which a laser light source and a deflector are used as an exposing section, the image forming apparatus 100 can serve as a laser printer. Further, the image forming apparatus 100 can also serve as a digital copying machine or a facsimile if a document reader is arranged between the ADF 110 and the exposing section 120.

In FIG. 8, when an image forming operation is started, the photosensitive drum 103 is charged by the charging device 106 and then exposed for a document image from the exposing section 120 so that a static latent image is formed on it. The static latent image is developed by developer (e.g., two-component developer or one-component developer) in the developing device 102, and a toner image is formed on the photosensitive drum 103. A toner image formed on the photosensitive drum 103 is transferred to a transfer paper (P) fed to a transfer section (i.e., a nip portion between the photosensitive drum 103 and the transfer belt 104*a* of the transfer device 104) through the resist roller 107 from the paper feed section 140. The transfer paper (P) to which the toner image is transferred is delivered to the fixing device 109 by the transfer belt 104*a* of the transfer device 104, and the toner image is fixed to the transfer paper (P) by the fixing device 109. The transfer paper (P) carrying the fixed toner image is delivered to a paper output tray (not shown).

The photosensitive drum 103, after transferring the toner image, is cleaned by the photosensitive body cleaning device 108 to salvage or remove the remaining toner and contaminants, such as paper lint. The transfer belt 104*a*, after transfer paper delivery, is also cleaned by a cleaning device 104*b* to salvage or remove the remaining toner and paper lint.

In this example, in the developing device 102, a magnetic brush developing method using two-component developer including toner (T) and carrier is applied.

The toner supplying device 0, which is arranged apart from the developing position of the developing device 102, is connected to the developing device 102 via a flexible toner conveying pipe as the toner/air mixture conveying path 101 through which toner is conveyed while being mixed with air. Toner stored in each of the toner containers 1 set in the toner supplying device 0 is supplied to the developing device 102 through the toner/air mixture conveying path 101 by a powder pump unit as the toner delivery device 6. As illustrated in FIG. 8, in this embodiment, the powder pump unit 6 is arranged in a lower portion of the toner supplying device 0.

For the toner/air mixture conveying pipe, it is advantageous to use a material which is flexible and has excellent resistance to toner, such as, for example, nylon, Teflon, etc. In the image forming apparatus 100 in this embodiment, the connection between the developing device 102 and the toner supplying device 0 is flexible, whereby limits on each location are removed, and therefore it is possible to utilize the layout effectively. Further, because the toner supplying device 0 is positioned apart from the developing device 102 at a lower right hand of the image forming apparatus 100, the operability of attaching and detaching a toner container 1 to and from the toner supplying device 0 is made easy.

Figure 9:
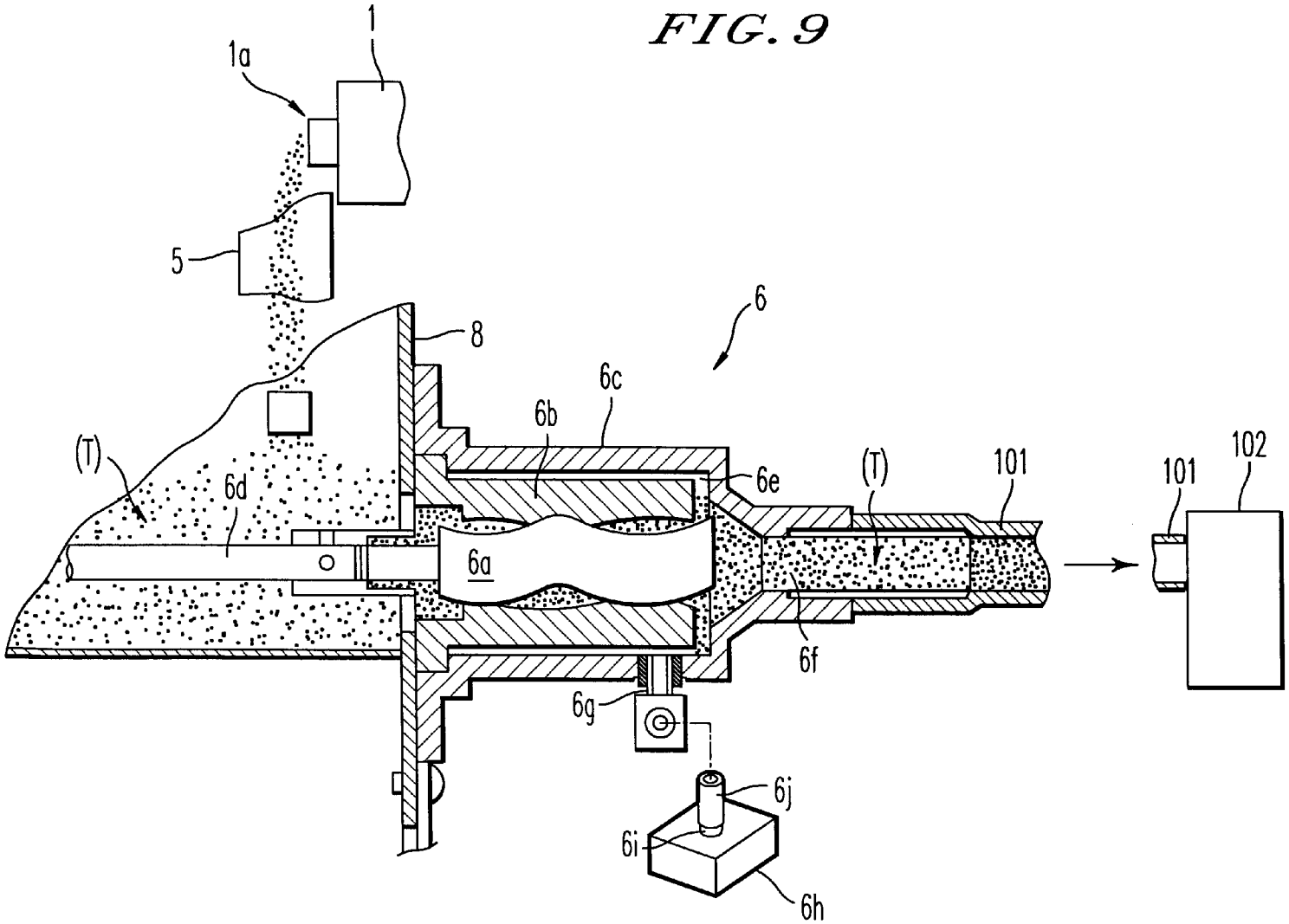
FIG. 9 is a sectional view showing a configuration of a powder pump unit used in the image forming apparatus as the toner delivery device for transferring toner from the toner supplying device to the developing device.

FIG. 9 is a sectional view showing a configuration of the powder pump unit as the toner delivery device 6 for transferring toner from the toner supplying device 0 to the developing device 102. Toner exiting from the toner container 1 through the opening 1*a* to the toner exhaust path 5 is deposited in the toner deposit part 8, and the deposited toner is then conveyed by the powder pump unit 6 to the developing device 102. For the powder pump unit 6, a screw pump which is conventionally known and commonly called a Moineau-pump is used. As shown in FIG. 9, the powder pump unit 6 includes a rotor 6*a*, a stator 6*b*, and a holder 6*c*.

The rotor 6*a* is engaged with a driving source, such as a driving motor (not shown) via a driving shaft 6*d* (or in some cases a horizontal delivery screw with a screw attached to the driving shaft on its outer periphery), and the rotor 6*a* is rotatively driven by a rotation of the driving source. The stator 6*b* is made of an elastic body, such as a rubber material, and surrounds the rotor 6*a*. The holder 6*c* holds the stator 6*b*.

The toner delivery device 6 takes in toner at the bottom part of the toner supplying device 0 from the side of the driving shaft 6*d* to deliver the toner toward a toner passageway (i.e., a discharging section) 6*f* with a rotation of the rotor 6*a*. In addition, there is about a 1-mm gap 6*e* between a side of the stator 6*b* and an inner side of the holder 6*c* in communication with the toner passageway 6*f*. An air supply port 6*g* is provided so that air blows from the gap 6*e* to the toner passageway 6*f*. The air supply port 6*g* communicates with the toner passageway 6*f*, and further communicates with an air exhaust outlet 6*i* of an air pump as an air supplying device 6*h* via an air supply tube 6*j*. When the air pump 6*h* starts to run, air blows on the toner (T) in the toner passageway 6*f* via the air supply tube 6*j* and the air supply port 6*i* at approximately 0.5 to 1 liter/minute, whereby fluidization is accelerated for toner that is discharged from the toner passageway 6*f* of the powder pump unit 6. Thus, the toner is discharged to the toner conveying pipe 101 while being mixed with air. Therefore, toner delivery with the powder pump 6 becomes more reliable.

Figure 10:
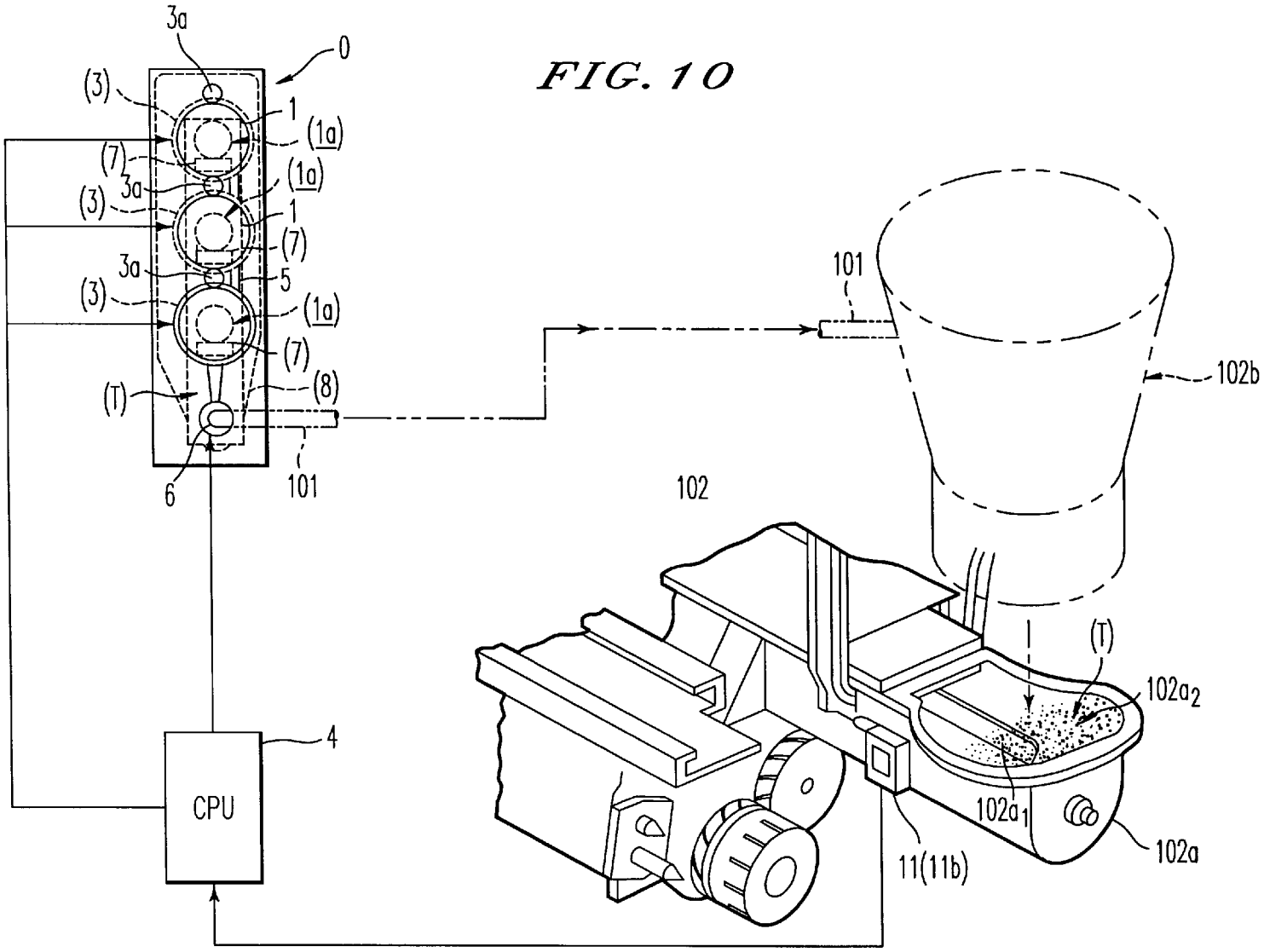
FIG. 10 is a schematic drawing illustrating the main portion of the developing device for explaining control of toner supply from the toner supplying device to the developing device.

FIG. 10 is a schematic drawing illustrating the main portion of the developing device 102 for explaining control of toner supply from the toner supplying device 0 to the developing device 102. In this embodiment, toner supply from the toner supplying device 0 to the developing device 102 is performed by the sensor 11*b* of the toner detect device 11, which is provided to a toner supplying section 102*a* of the developing device 102, and the CPU of the toner container selection control device 4.

When a main motor (not shown) is turned on and a toner container 1 held by the toner container holder 3 starts to be rotated by the rotation drive device 3*a*, toner (T) contained in the toner container 1 is exhausted through an opening 1*a*, which is provided at an axial end of the container 1, into the toner exhausting path 5. The toner exhausted to the toner exhausting path 5 from each toner container 1 is conveyed to the toner deposit part 8 at the bottom of the toner exhausting path 5. The toner deposited in the toner deposit part 8 is mixed with air by the toner delivery device 6 and is then conveyed to the toner supplying section 102*a* of the developing device 102.

The supply of toner to the developing device 102 is controlled by the sensor 11*b* of the toner detect device 11, which is provided to the toner supplying section 102*a* and the CPU of the toner container select control device 4.

If the sensor 11*b* does not detect the toner, that is, when the height of the accumulated toner in the toner supplying section 102*a* of the developing device 102 is lower than a predetermined level, the powder pump unit 6 is driven to supply toner from the toner supplying device 0 to the toner supplying section 102*a* of the developing device 102. When the height of the accumulated toner in the toner supplying section 102*a* reaches the predetermined level, the toner is detected by the sensor 11*b* and the supply of toner to the toner supplying section 102*a* from the toner supplying device 0 is stopped. With these controls, the toner supplying section 102*a* always contains a certain amount of toner, so that a stable developing process is assured.

Additionally, if the sensor 11*b* does not detect the toner a predetermined number of times (i.e., at periodic or predetermined intervals ) or for a predetermined period of time, it is determined that the operating toner container 1 is almost exhausted. Then, toner contained in another toner container 1 starts to be discharged to the toner conveying path 5 so as to be deposited in the toner deposit part 8. The toner deposited in the toner deposit part 8 is then conveyed to the toner supplying section 102*a* of the developing device 102 by activating the toner delivery device 6. In the toner supplying section 102*a* of the developing device 102, as illustrated in FIG. 10, a toner supplement opening 102*a*2 is formed at the side of an axial end of a stirring member 102*a*1 arranged in the toner supplying section 102*a*, and in this toner supplement opening 102*a*2, a toner salvaging device 102*b* described next is removably attached.

Figure 11:
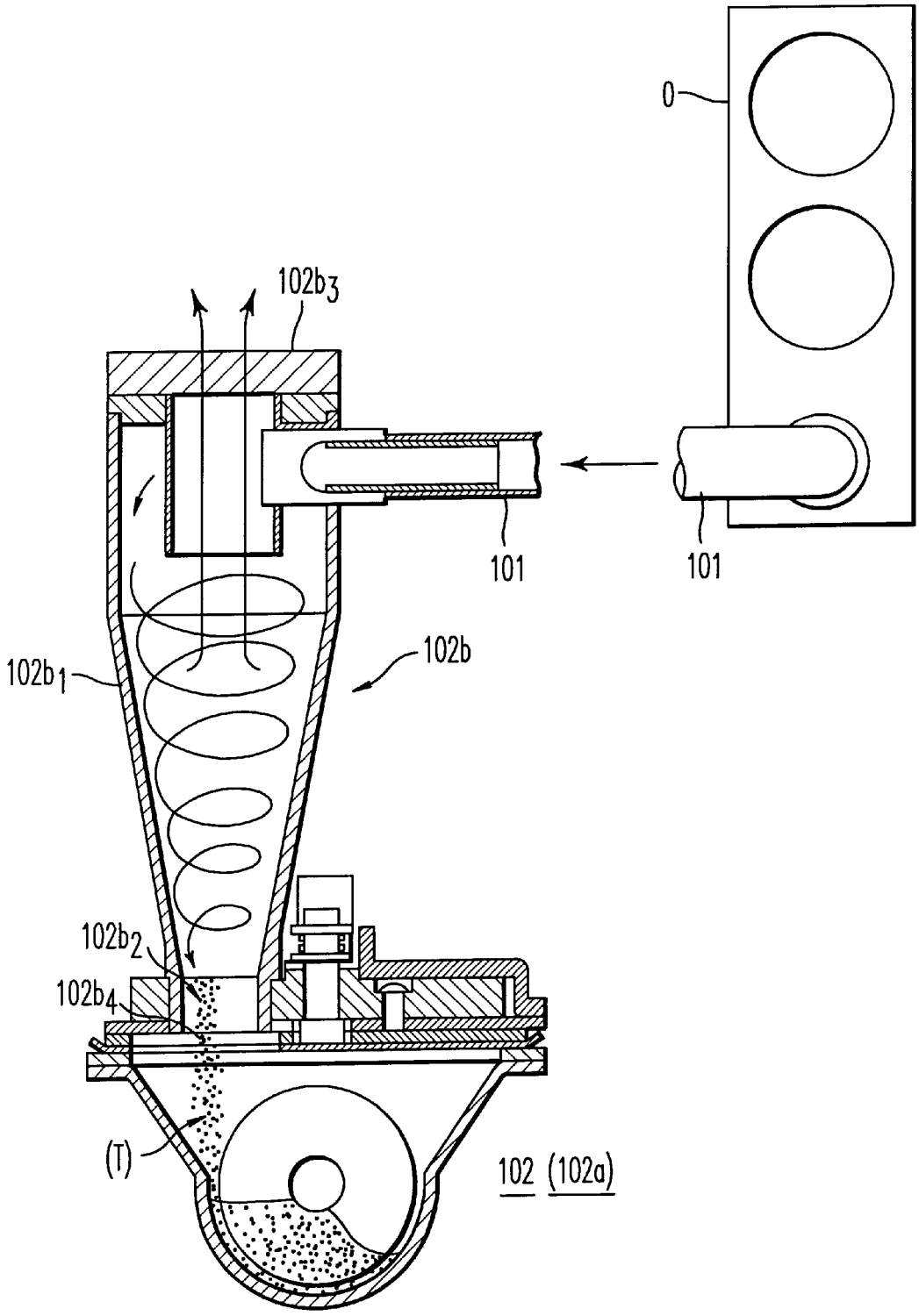
FIG. 11 is a schematic drawing illustrating an example of a toner salvaging device attached to the toner supplying section of the developing device.

FIG. 11 is a schematic drawing illustrating an example of the toner salvaging device 102*b* attached to the toner supplying section 102*a* of the developing device 102. The toner salvaging device 102*b* has a unit structure that is configured separately from the developing device 102. The toner salvaging device 102*b* is used to salvage toner that has been delivered while being mixed with air through the toner/air mixture conveying path 101 from the toner supplying device 0 by separating the toner (T) from the air so as to supply the toner in preparation for decreased supplement toner in the toner supplying section 102*a* of the developing device 102.

In FIG. 11, the toner salvaging device 102*b* has a funnel-shaped toner separating section 102*b*1 whose longer direction is vertical. The toner separating section 102*b*1 includes a hopper that separates air from toner transmitted from the toner supplying device 0, and drops only the toner by gravity, so as to put the toner into the toner supplying section 102*a* of the developing device 102. Therefore, in the upper part of the toner separating section 102*b*1, an end of the toner/air mixture conveying path 101, through which the toner is delivered from the toner supplying device 0, is connected, while an opening 102*b*2, which can be connected to the toner supplying section 102*a* of the developing device 102, is formed in the lower part. With this configuration, a mixture of air and toner transmitted from the toner/air mixture conveying path 101 falls spiraling, when striking an inner wall of the toner separating section 102*b*1, due to the shape of the toner separating section 102*b*1 and the discharging position of the toner/air mixture conveying path 101. The air having a lower specific gravity rises, while the toner having a higher specific gravity drops, and thereby the air is separated from the toner. On the top surface of the toner separating section 102*b*1, there is a filter 102*b*3 for discharging only air, and on the bottom surface, there is an opening/closing member 102*b*4 for opening or closing the opening 102*b*2.

Figure 12:
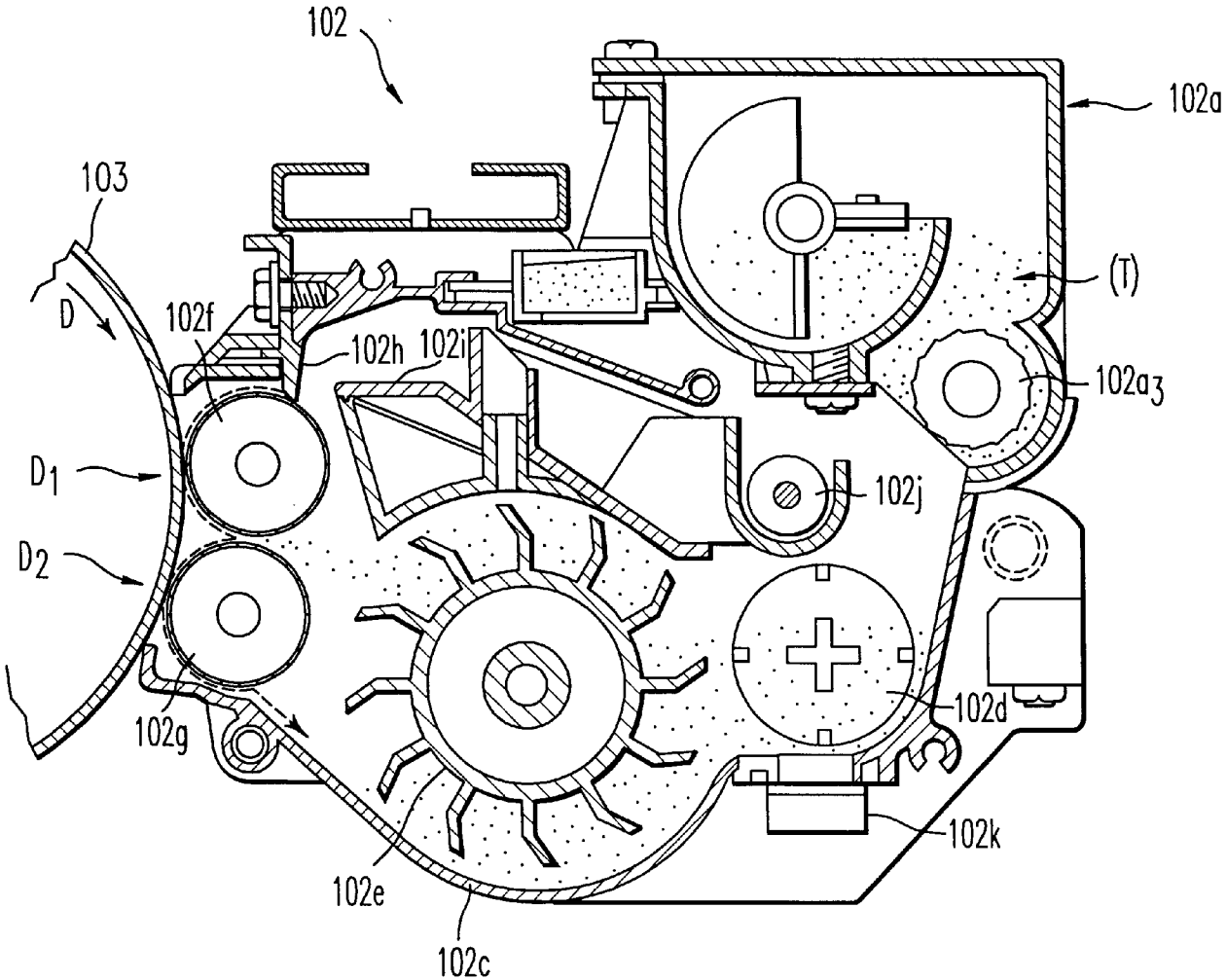
FIG. 12 is a sectional view illustrating an example of a configuration of the developing device.

FIG. 12 is a sectional view illustrating an example of a configuration of the developing device 102. In FIG. 12, the developing device 102 has a developing container 102*c* and the toner supplying section 102*a*. The developing container 102*c* is arranged near the photosensitive drum 103, which is a latent image carrier movable in a direction indicated by an arrow D in the drawing. The toner supplying section 102*a* is mounted on the developing container 102*c*. In the developing container 102*c*, a stirring roller 102*d* and a paddle wheel 102*e* are arranged for development, so as to scoop up two-component developer having magnetic or non-magnetic toner and magnetic carrier subjected to frictional electrification in opposite polarities by being stirred and mixed by the stirring roller 102*d* and the paddle wheel 102*e*. In addition, the toner supplying section 102*a* stirs the toner (T) with a rotation of a toner supplying roller 102*a*3 and transmits it toward the stirring roller 102*d* if a density of the toner supplied to the photosensitive drum 103 is lowered.

In a position where the developer is scooped up by the paddle wheel 102*e*, there are arranged a plurality of, e.g., two shown in the drawing, developing rollers 102*f* and 102*g* near the photosensitive drum 103. The two developing rollers 102*f* and 102*g* are arranged in the upstream side and the downstream side along a moving direction of the photosensitive drum 103. The roller in the upstream side is considered to be a first developing roller 102*f* and the roller in the downstream side is to be a second developing roller 102*g*. The first and second developing rollers 102*f* and 102*g* include a developing sleeve that is rotatable in a counterclockwise direction in the drawing by a driving section (not shown) and a magnetic roller fixed in the developing sleeve as the main portion. This developing sleeve is made of a non-magnetic body, such as aluminum or stainless steel. The magnetic roller includes a plastic magnet molded by mixing a ferrite magnet or a rubber magnet, and further nylon powder and ferrite powder, having a configuration in which a plurality of magnetic poles are arranged along a circumferential direction.

In the developing container 102*c*, the developer is scooped up by a centrifugal force generated at a rotation of the paddle wheel 102*e* and then expelled toward the first developing roller 102*f*. A part of the expelled developer is supplied directly to the first developing roller 102*f* and carried on a surface of the first developing roller 102*f*. Another part of the remaining developer to be expelled rebounds from the second developing roller 102*g* and then is carried on the surface of the first developing roller 102*f* by way of a magnetic force in the side of the first developing roller 102*f*. To supply the developer to the first developing roller 102*f* also from the side of the second developing roller 102*g*, it is desired to increase a relative rotation speed of the paddle wheel 102*e* in order to increase the amount of developer rebounding from the second developing roller 102*g* so as to increase the centrifugal force in advance.

The developer carried on the surface of the first developing roller 102*f* moves on the roller surface with a rotation of the developing sleeve, and after the layer thickness is restricted by a doctor blade 102*h*, it reaches a first developing area D1 in which the first developing roller 102*f* is opposite to the photosensitive drum 103, so that a latent image on the photosensitive drum 103 is made visible with toner. Then, the developer which has passed the first developing area D1 moves to a position where the magnetic force in the side of the first developing roller 102*f* has a lower effect. Thus, the developer is transmitted toward a second developing area D2 between the second developing roller 102*g* and the photosensitive drum 103, as indicated by a dashed line in the drawing, with a rotation in the side of the second developing roller 102*g* and a magnetic force from the magnetic roller. Then, the developer drops to the bottom of the developing container 102*c* in a position where the second developing roller 102*g* has no effect, and the developer is stirred again by the paddle wheel 102*e*.

On the other hand, the developer scraped off the first developing roller 102*f*, due to restriction of the layer thickness with the doctor blade 102*h*, is guided by a separator 102*i* toward a delivery screw 102*j* located at the other end of an extension of the separator 102*i*. The developer is then dropped on the stirring roller 102*d* by the delivery screw 102*j*. Therefore, at the other end of the extension of the separator 102*i*, there is a slit for dropping the developer formed in a position opposite to the stirring roller 102*d*.

The magnetic rollers arranged in the first and second developing rollers 102*f* and 102*g* have an arrangement of magnetic poles, which can be used to form a repulsive magnetic field generated by the identical poles between the nearest portions of the first developing roller 102*f* and the second developing roller 102*g*, so that the transfer direction of the developer is forcibly set to a direction in which the developer starts for the second developing roller 102*g*. With this arrangement, the developer is transferred to the second developing roller 102*g* by the magnetic pole in the side of the second developing roller 102*g*.

Near the stirring roller 102*d* in the developing container 102*c*, there is arranged a toner density sensor as a toner density detecting device 102*k* for detecting a mixing ratio of toner and carrier. The toner density sensor 102*k* employs, for example, a method in which a toner density is detected based on a content of the toner in the developer by using changes of inductance on a coil arranged in the developer.

Figure 13:
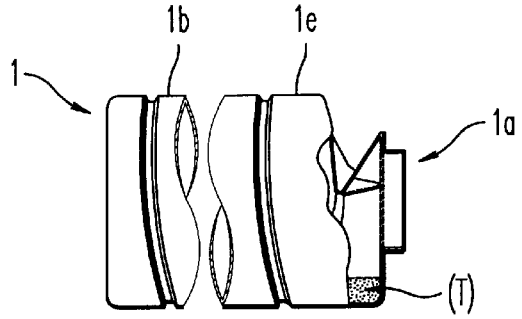
FIGS. 13$a_1$–13$d_2$ are a series of schematic drawings for explaining how toner is discharged from a toner container.
Figure 13:
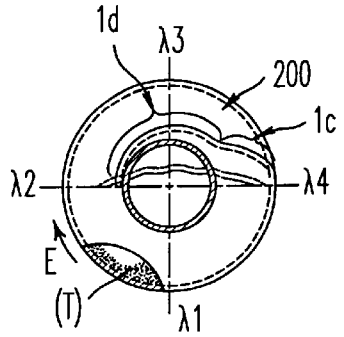
Figure 13:
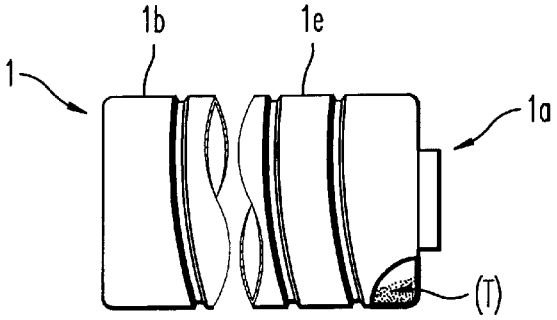
Figure 13:
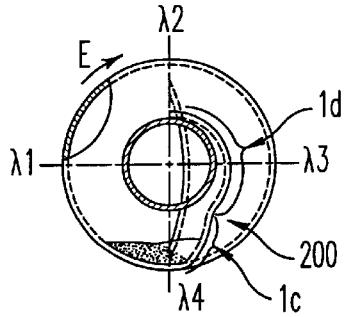
Figure 13:
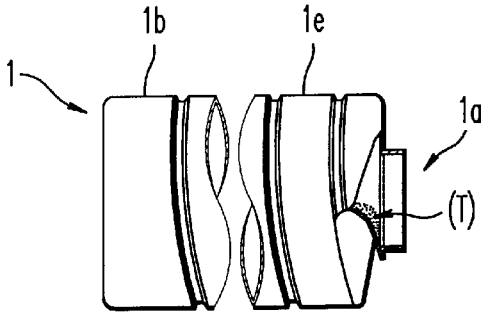
Figure 13:
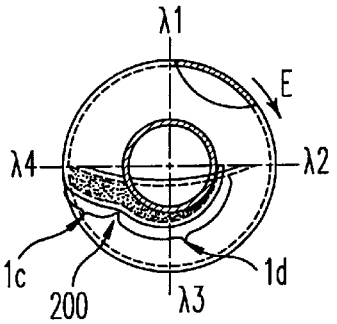
Figure 13:
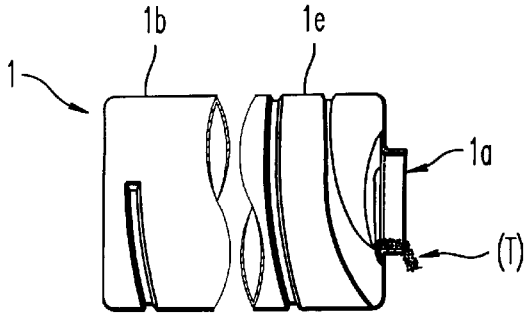
Figure 13:
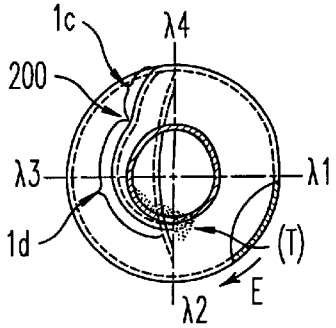

FIGS. 13*a*1–13*d*2 illustrate how toner is discharged from the toner container 1. FIGS. 13*a*1, 13*b*1, 13*c*1 and 13*d*1 are elevational views of the toner container 1 and FIGS. 13*a*2, 13*b*2, 13*c*2 and 13*d*2 are corresponding right-side views of the toner container 1. FIGS. 13*b*1 and 13*b*2 show views rotated from FIGS. 13*a*1 and 13*a*2 by 90 degrees, FIGS. 13*c*1 and 13*c*2 show views rotated from FIGS. 13*b*1 and 13*b*2 by 90 degrees, and FIGS. 13*d*1 and 13*d*2 show views rotated from FIGS. 13*c*1 and 13*c*2 by 90 degrees, respectively.

As illustrated, the toner container 1 is formed with the opening 1*a* for discharging toner at an end of a cylindrical container body 1*b* so as to have a smaller diameter than a diameter of the cylindrical body 1*b*. A shoulder part 200 is formed at an end part holding the opening 1*a*. In addition, a spiral groove or protrusion is formed inside the container 1 toward the opening 1*a*. Because of this configuration, the rotation of the container 1 in a direction E causes toner contained in the container 1 to be conveyed by the spiral groove or protrusion toward the opening 1*a* through the shoulder part 200 and discharged from the container 1.

Further, with a part of the inner surface of the shoulder part 200 of the end part on which the opening 1*a* of the toner container 1 is formed being pushed out from the inner surface of the shoulder part 200 up to an edge of the opening 1*a*, a projected portion 1*c* for raising toner is formed.

Specifically, FIGS. 13*a*2, 13*b*2, 13*c*2 and 13*d*2 illustrate how toner is guided by the projected portion 1*c* of the toner container 1 and an opening projected portion 1*d*. In each of FIGS. 13*a*2, 13*b*2, 13*c*2 and 13*d*2, symbols λ1, λ2, λ3, and λ4 are used to refer to imaginary radial lines that extend outward from an axis of the toner container 1. The radial lines represented by symbols λ1, λ2, λ3, and λ4 are at a fixed angular position with respect to the toner container 1, with λ1 representing a 0 degree angle (and 360 degree angle), λ4 representing a 90 degree angle, λ3 representing an 180 degree angle, and λ2 representing a 270 degree angle. In FIGS. 13*a*1 and 13*a*2, each part of the maximum diameter in the shoulder part 200 is located vertically downward and toner is guided to the lower part of the circumferential wall in the maximum-diameter part of a head portion of the toner container 1 by a guiding groove 1*e*. In the state illustrated in FIGS. 13*b*1 and 13*b*2, after a rotation by 90 degrees from the above state in a direction indicated by the arrow E, a borderline area between the maximum-diameter part of the shoulder part 200 and the projected portion 1*c* are located vertically downward and a part of the toner guided by the above guiding groove 1*e* is put on the projected portion 1*c*. During a further rotation by 90 degrees from this state to the state illustrated in FIGS. 13*c*1 and 13*c*2 in a direction indicated by the arrow E, the projected portion 1*c* raises the toner up to an edge of the opening 1 a as if it were a spoon. Before or after the state illustrated in the FIGS. 13*d*1 and 13*d*2 after a further rotation by 90 degrees in a direction indicated by the arrow E, the above toner on the projected portion 1*c* is partially transferred to the opening projected portion 1*d* and then discharged from the opening 1*a* due to an incline of the opening projected portion 1*d*. In this point, the projected portion 1*c* itself is recessed like a scooping part of a spoon as apparently illustrated in FIG. 13*c*2 in this example. By using a toner container having this shape near the opening 1*a*, it is possible to prevent a discharge and the dropping of a lump of toner, and also preventing scattering of toner powder dust in the toner deposit portion at the bottom of the toner supplying device 0. Thus, the toner is gradually discharged from the toner container 1 through the opening 1*a*. In addition, it is possible to use almost the entire toner contained in the toner container 1, without leaving some of the toner. Furthermore, extra toner is removed by the rotation of the toner container 1 and only a spoonful of toner is scooped up to the opening 1*a*, and therefore toner is discharged stably from the opening 1*a*.

Next, an exemplary mechanism for opening and closing the opening 1*a* at an end of the toner container 1 with a cap is described with reference to FIG. 14.

Figure 14:
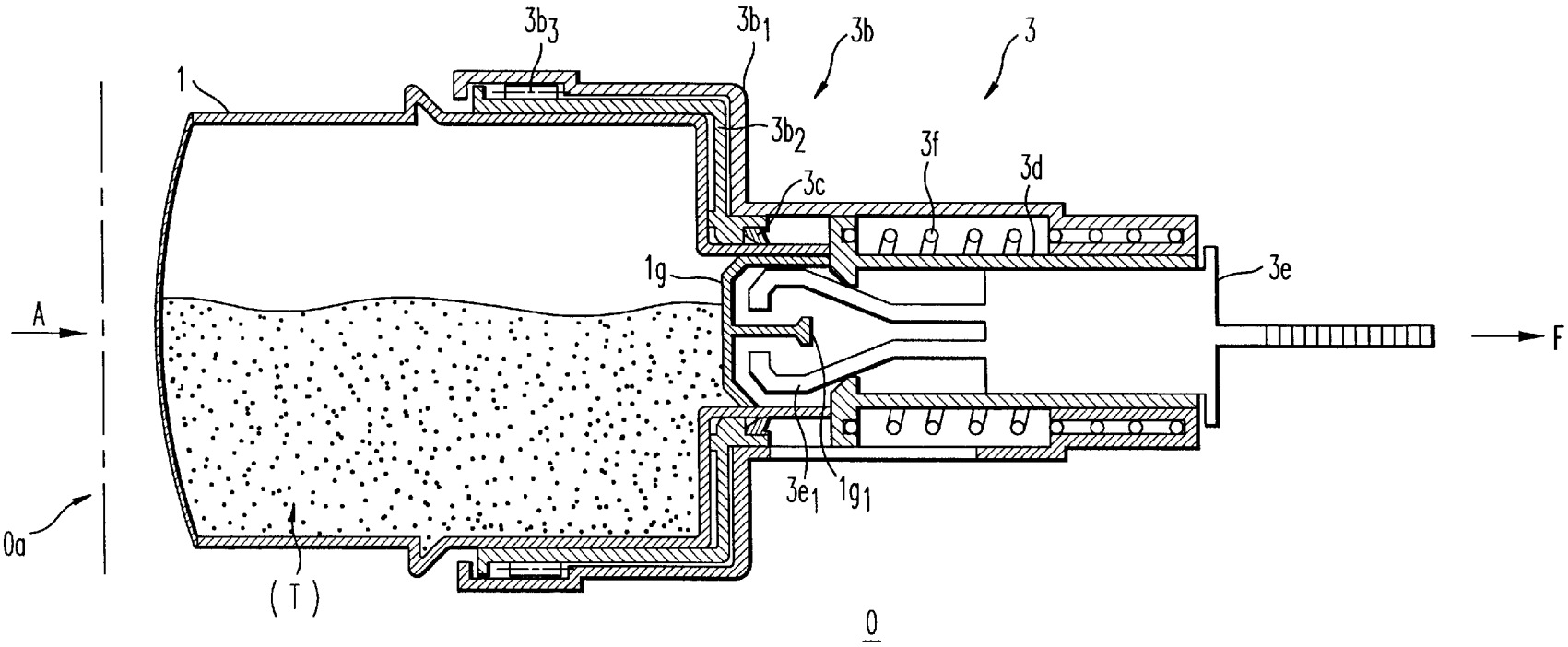
FIG. 14 is a schematic drawing illustrating an exemplary mechanism used in the toner supplying device for opening and closing an opening of the toner container with a cap.

FIG. 14 illustrates the toner container 1 being set in a holder portion 3*b* of the toner container holder 3 of the toner supplying device 0 and the opening 1*a* being closed with a cap 1*g*. In the holder portion 3*b*, there is provided a rotatably-supported inner holder 3b2 in a holder 3b1 . The inner holder 3b2 is rotated by a gear drive (not shown) via a driving gear 3b3. The toner container 1 has recess and projecting portions (not shown) so that it can rotate synchronously with this inner holder 3b2. In the inner holder 3b2, a seal 3c is arranged so as to prevent toner from being scattered from a gap between the toner container 1 and a supporting section of the inner holder 3b2. In the holder 3b1, a slider 3d and a chuck 3e are supported so as to respectively slide freely.

The slider 3d is pressed by a spring 3f in a direction that urges the cap 1g toward the toner container 1. When the chuck 3e is shifted in a direction indicated by an arrow F from this state, as illustrated in FIG. 14, a grab portion 1g1 of the cap 1g is held by a click 3e1 of the chuck 3e and then the cap 1g is drawn out of the toner container 1, whereby the opening 1a is opened.

Figure 15:
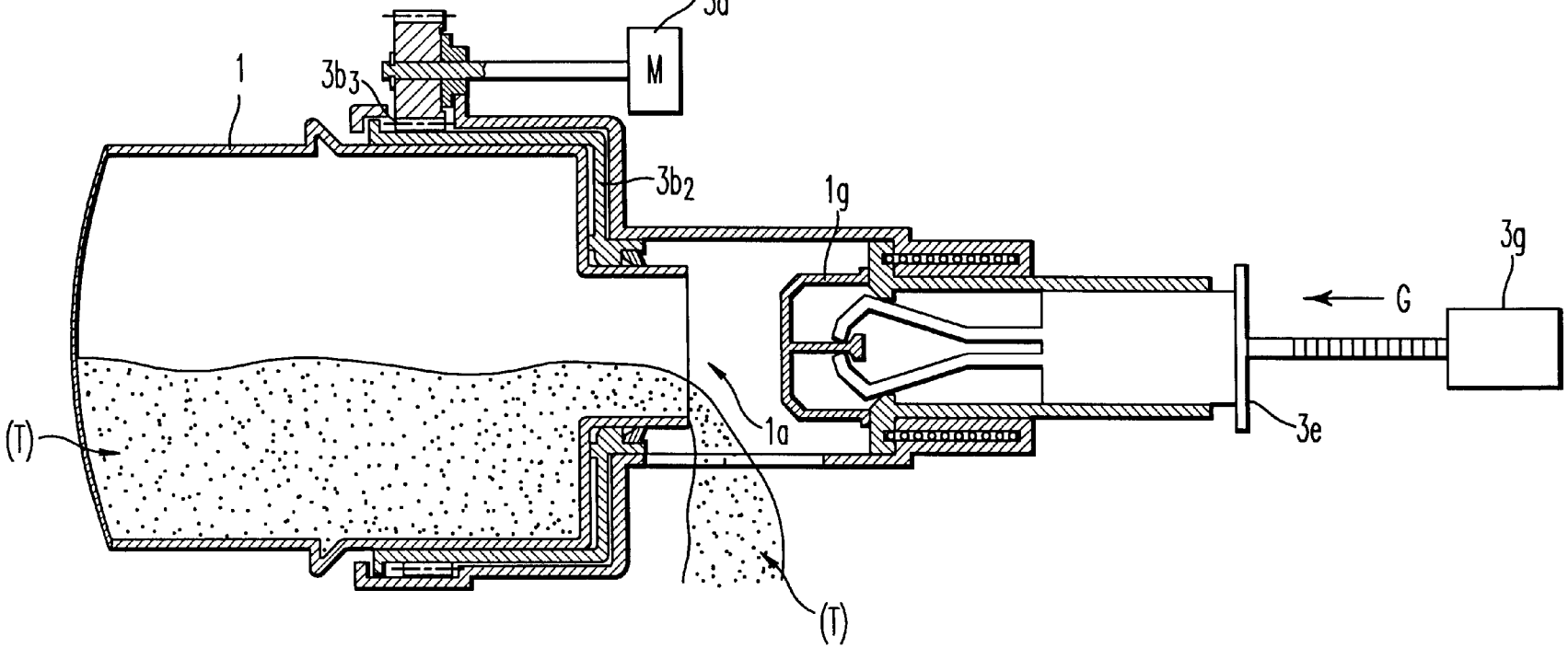
FIG. 15 is a schematic drawing illustrating a state of the opening/closing mechanism when the cap of the toner container is taken off to open the opening.

FIG. 15 is a schematic drawing illustrating a state of the opening/closing mechanism when the cap 1g of the toner container 1 is taken off to open the opening 1a. In FIG. 15, when the driving gear 3b3 is rotated by a gear of the rotation driving device 3a in this state, the inner holder 3b2 rotates and the toner container 1 rotates synchronously with this rotation, whereby toner (T) in the toner container 1 is discharged from the opening 1a. If the toner (T) remaining in the toner container 1 becomes less than a predetermined amount, as determined by the toner detect device 111 and the CPU of the toner container section control device 4, after a predetermined period of time sufficiently long for using up the remaining toner of the toner container 1, the opening 1a of the toner container 1 is closed by the cap 1g by shifting the chuck 3e with a moving device 3g in a direction indicated by the arrow G in FIG. 15.

Figure 16:
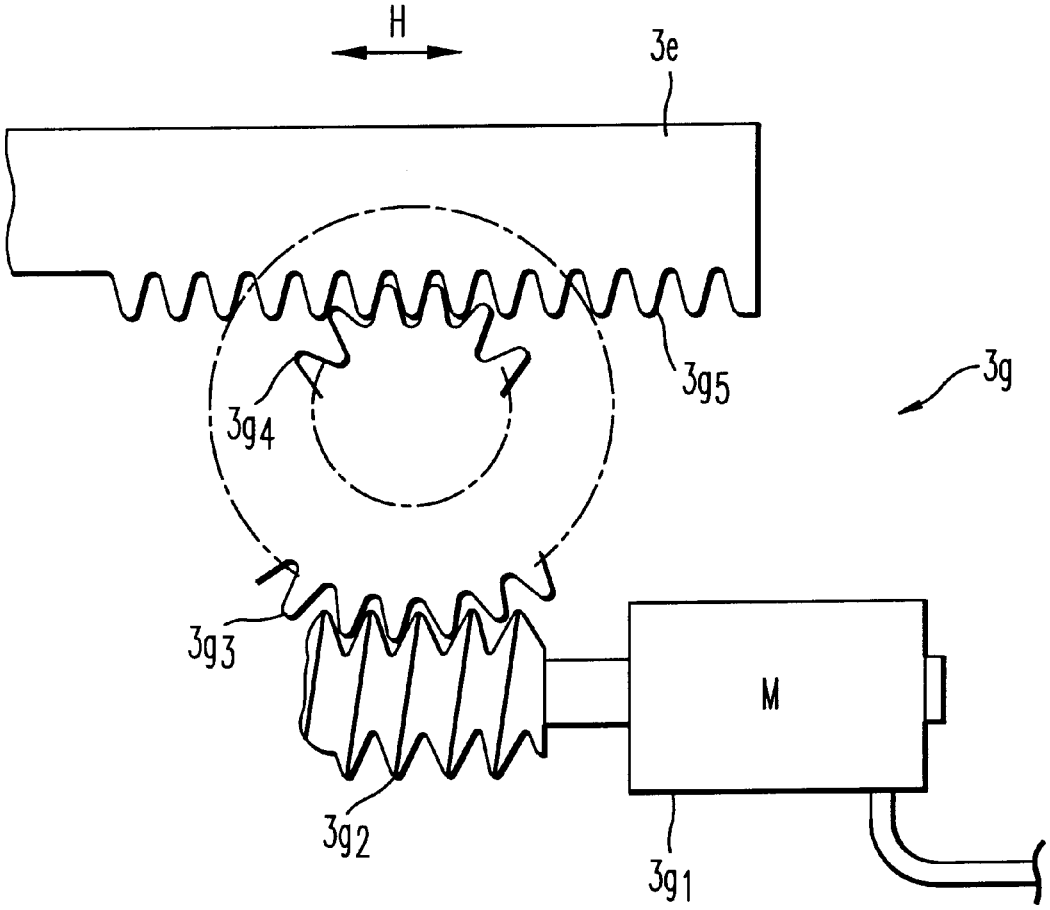
FIG. 16 is a schematic drawing illustrating an exemplary construction of a moving device that moves a chuck of the opening/closing mechanism to open and close the opening of the toner container.

FIG. 16 is a schematic drawing illustrating an exemplary construction of the moving device 3g. As illustrated in FIG. 16, the moving device 3g includes a driving motor 3g1, a worm gear 3g2, a helical gear 3g3, a pinion 3g4, and a rack 3g5. The chuck 3e is moved in a horizontal direction as indicated by an arrow H in the drawing with a rotation of the driving motor 3g1 in a clockwise direction or a counter-clockwise direction, whereby the cap 1g can be put on or taken off the opening 1a of the toner container 1. When the cap 1g is put on the opening 1a of the toner container 1, a stopper (illustrated in FIG. 17) is used to prevent the toner container 1 from being moved.

Figure 17:
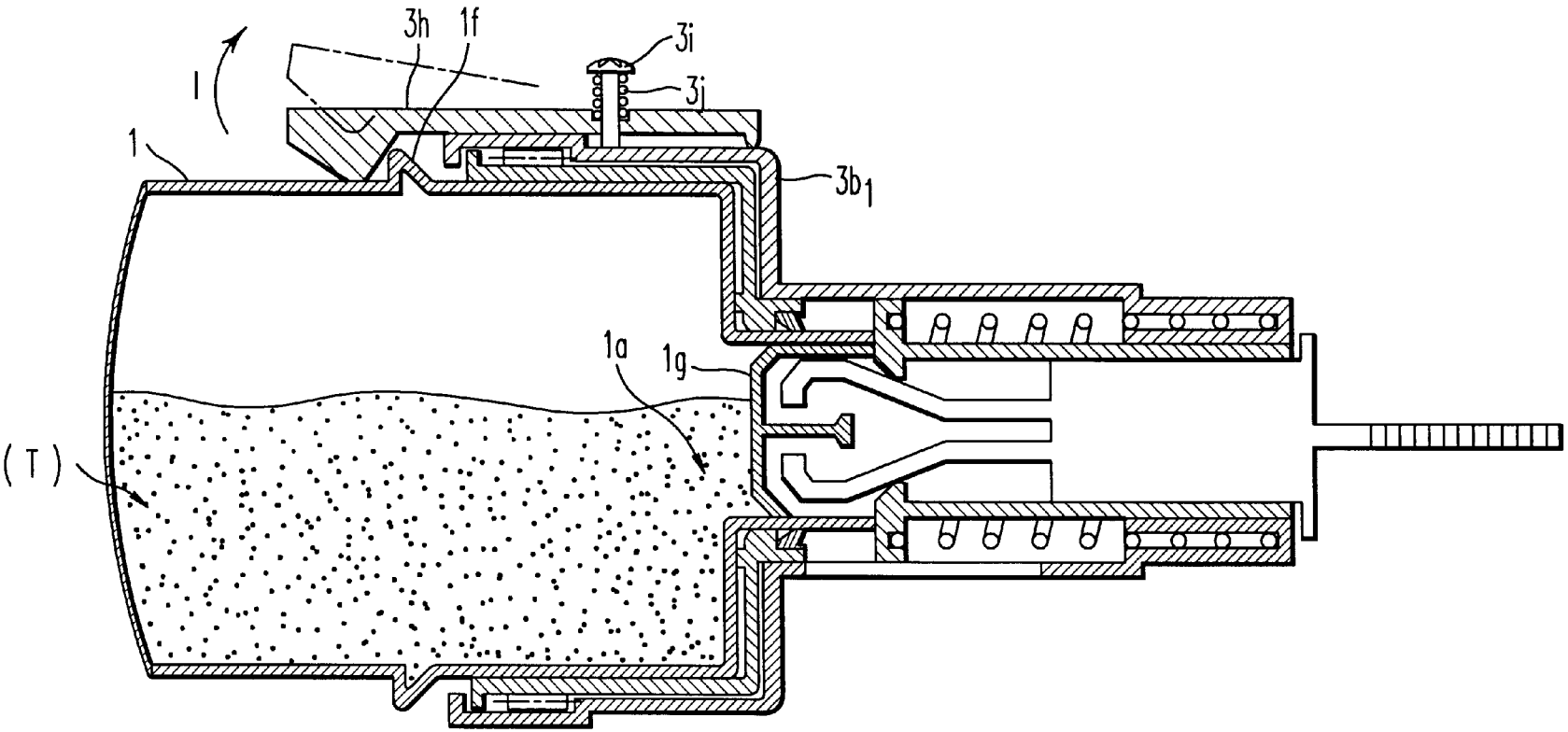
FIG. 17 is a schematic drawing illustrating a stopper that is used to prevent the toner container from being removed from the toner supplying device.

In FIG. 17, a stopper 3h is supported by a stepped screw 3i and a spring 3j so as to be fixed to the holder 3b1, with its click portion being engaged with a projection 1f arranged on an outer peripheral surface of the toner container 1. The stopper 3h is pressed by the spring 3j so as not to be raised up to the position indicated by a two-dotted and dashed line in FIG. 17 by a force of closing the cap 1g. Accordingly, the cap 1g can be put on the opening 1a of the toner container 1 securely. In addition, when exchanging the toner container 1, the toner container 1 can be easily removed from the stopper 3h, so that it can be easily exchanged, by pulling out the toner container 1 more strongly or by withdrawing the stopper 3h manually or with an added lever or the like to the position indicated by the two-dotted and dashed line in FIG. 17.

Figure 18:
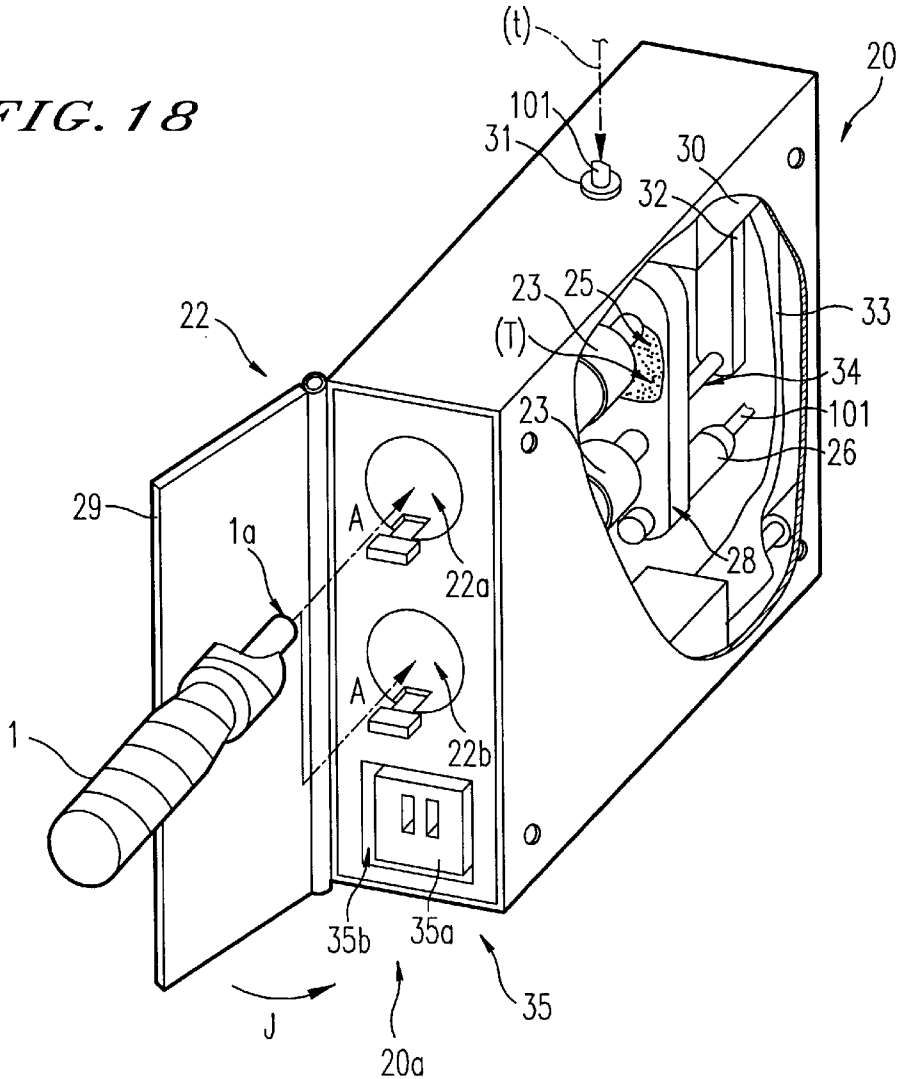
FIG. 18 is a schematic drawing illustrating a toner supplying device including a collected used toner accommodating device according to another embodiment of the present invention.
Figure 19:
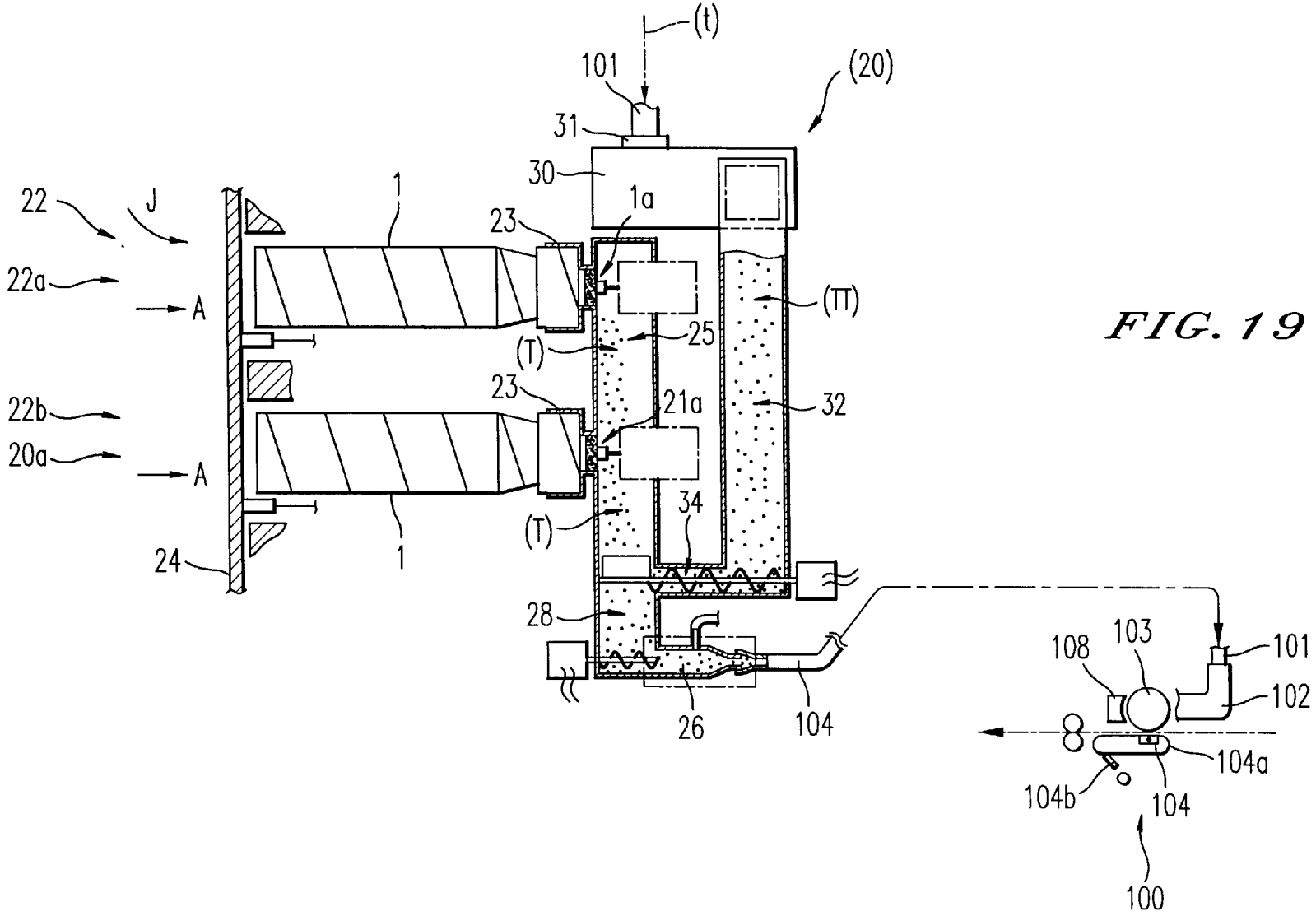
FIG. 19 is a schematic drawing illustrating a sectional view of the toner supplying device for explaining the construction of the toner supplying device and the relationship with an image forming part of an image forming apparatus.
Figure 20:
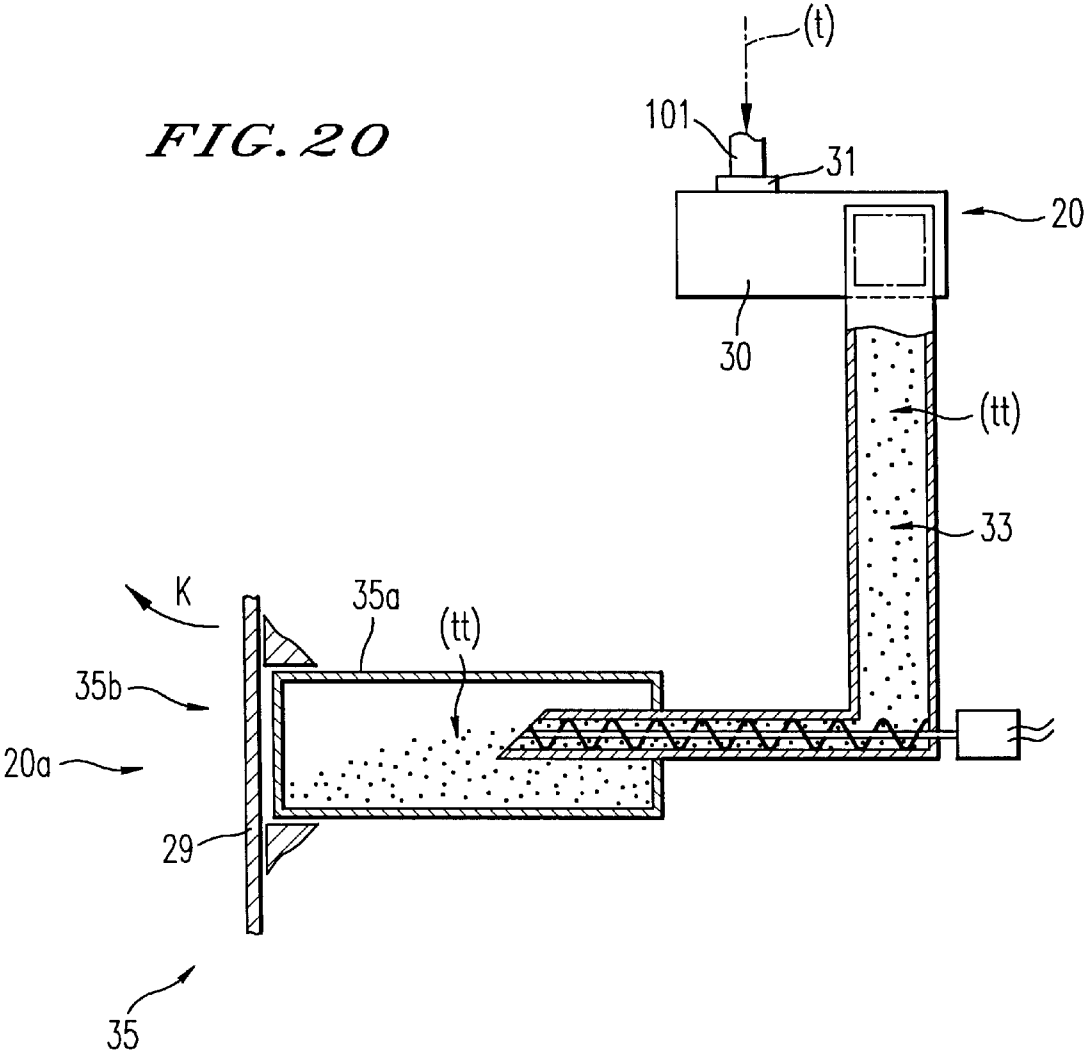
FIG. 20 is a schematic drawing illustrating a non-reusable used toner discarding part of the toner supplying device.

FIG. 18 is a schematic drawing illustrating a toner supplying device according to another embodiment of the present invention, FIG. 19 is a schematic drawing illustrating a sectional view of the toner supplying device for explaining the construction of the toner supplying device and the relationship with an image forming part of an image forming apparatus, and FIG. 20 is a schematic drawing illustrating a non-reusable used toner discarding part of the toner supplying device.

In FIGS. 18, 19, 20, a toner container 1 is inserted into toner container insertion inlets 22a and 22b in a direction indicated by an arrow A from the side of a front surface 20a of a toner supplying device 20, which is placed apart from a developing device 102 of an image forming apparatus 100. The toner container 1 is detachably held by a toner container holder 23. A open/close cover 29 rotates in a direction indicated by an arrow J so as to cover the front surface 20a, thereby preventing toner from scattering.

A used toner sorting device 30 is provided at the side where the opening 1a of the toner container 1 is positioned. The used toner sorting device 30 receives used toner, which is collected by a cleaning device 108 removing residual used toner from an image carrier 103 and another cleaning device 104b removing residual used toner from a transfer belt 104a of a transfer device 104 and which is conveyed through a toner/air mixture conveying path 101. The used toner sorting device 30 sorts the received used toner into reusable used toner and non-reusable used toner.

The toner container 1, which is optionally selected so as to be operated, discharges toner (T) through the opening 1a to a toner conveying path 25 while the other toner container 1 is kept not to discharge toner. The discharged toner deposited in a toner deposit part 28 is conveyed to the developing device 102 via the toner/air mixture conveying path 101 by being mixed with air with a powder pump, which is known as a Moineau-pump, as a toner delivery device 26.

The toner/air mixture conveying path 101 communicates with a collected used toner inlet 31 of the used toner sorting device 30. Used toner collected by the cleaning device 108 and another cleaning device 104b is conveyed through the toner/air mixture conveying path 101 to the collected used toner inlet 31.

Collected used toner (t) discharged through the collected used toner inlet 31 is sorted into reusable used toner and non-reusable used toner. Reusable used toner (TT) is conveyed through a reusable used toner conveying path 32 and is mixed with new toner (T) discharged from the operating toner container 1 in a merging part 34 communicating with the toner conveying path 25. The mixed toner is then conveyed to the developing device 102 by the toner delivery device 26.

Non-reusable used toner (tt), which is separated from reusable used toner by the used toner sorting device 30 is conveyed, as illustrated in FIG. 20, through a non-reusable used toner discharging path 33, which is provided at the side where the opening 1a of the toner container 1 is positioned. The non-reusable used toner is put in a discarding toner container 35a, which is inserted into a discarding toner container insertion part 35b of a collected used toner accommodating device 35 from the front surface 20a. The discarding toner container 35a can be removed from the used toner accommodating device 35 for discarding the non-reusable used toner by opening the open/close cover 29 covering the front surface 20a in a direction indicated by an arrow K.

Figure 21:
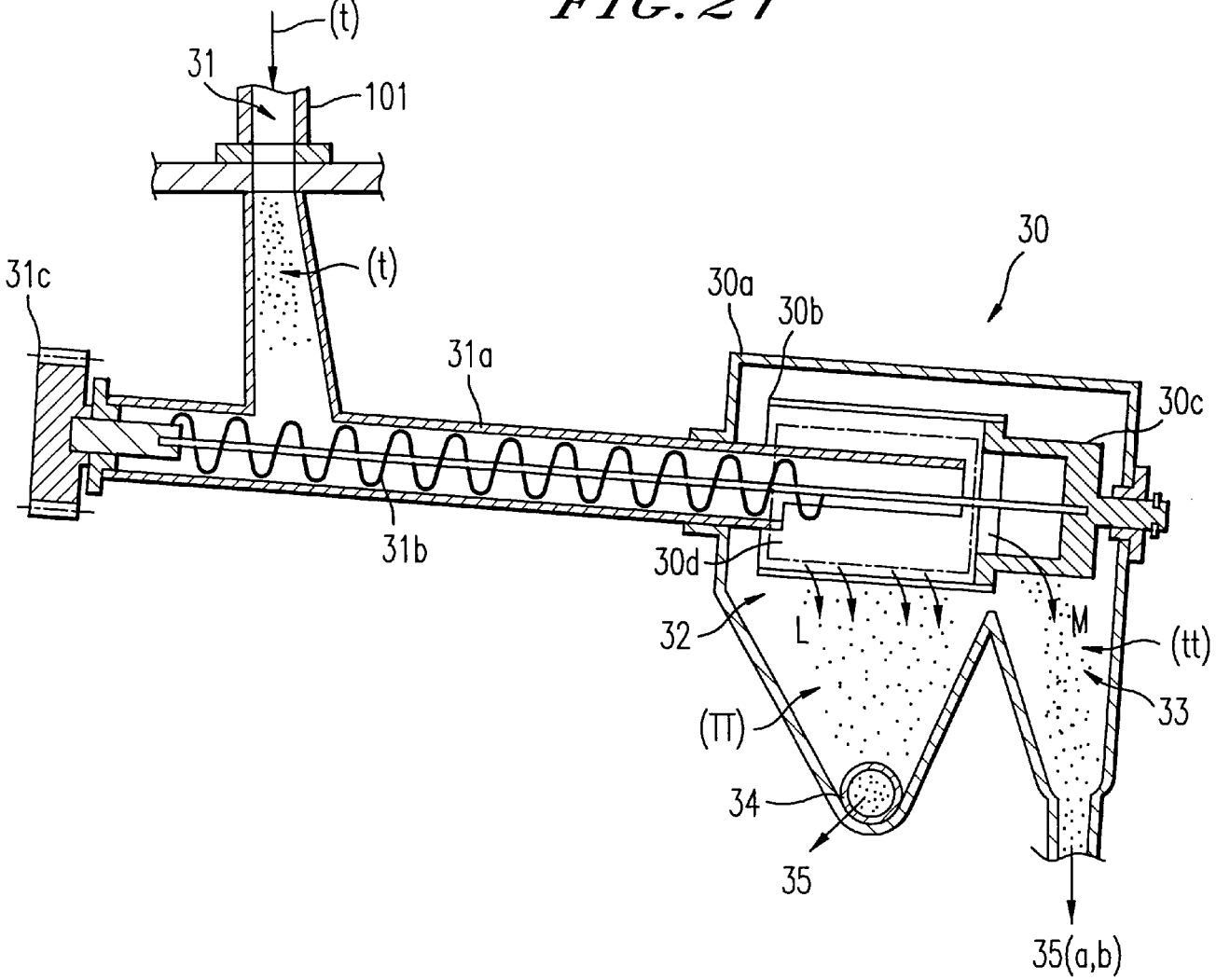
FIG. 21 is a sectional drawing illustrating an exemplary construction of a used toner sorting device provided in the toner supplying device.

FIG. 21 is a sectional drawing illustrating an exemplary construction of the used toner sorting device 30. Used toner (t), which is collected by the cleaning device 104b of the transfer device 104 and the cleaning device 105 of the image forming apparatus 100 (not shown) and which are conveyed through the toner/air mixture conveying path 101, is received through the collected used toner inlet 31 of the used toner sorting device 30. The received used toner is conveyed through a collected used toner conveying path 31*a* into a cylindrically shaped sifting unit 30*b*, which is included in a case 30*a* of the used toner sorting device 30. The used toner conveying path 31*a* includes a toner conveying screw 31*b* passing through the path 31*a*, and collected used toner (t) taken into the used toner sorting device 30 is conveyed into the sifting unit 30*b* by rotating the toner conveying screw 31*b* with a motor 31*c* as a driving source. The sifting unit 30*b* engages with a pipe of the used toner conveying path 31*a* at one end and is rotatably held by a support device 30*c* at the other end. The support device 30*c* engages with an axis of the toner conveying screw 31*b* and the sifting unit 30*b* is rotated by rotation of the toner conveying screw 31*b*.

A sorting accelerating device 30*d* that accelerates separation of reusable used toner from non-reusable used toner is provided in the sifting unit 30*b*. One end of the sorting accelerating device 30*d* is fixed to the pipe of the used toner conveying path 31*a* engaging with the sifting unit 30*b*, and the other free end of the sorting accelerating device 30*d* contacts the internal circumferential surface of a sieve provided in the cylindrically shaped part of the sifting unit 30*b*. As the sifting unit 30*b* is rotated, the free end part of the sorting accelerating device 30*d* presses the used toner (t) against the internal circumferential surface of the sieve, such that the used toner pressed against the sieve passes through meshes of the sieve and the separation of reusable used toner from non-usable used toner is accelerated. As the sorting accelerating device 30*d*, a flexible member shaped like a fur brush or a PET piece shaped like a film may be used.

Reusable used toner (TT) passed through the meshes of the sieve of the sifting unit 30*b* falls in a direction indicated by arrows L into a reusable used toner conveying path 32. The reusable used toner is mixed with new toner (T) conveyed through the toner conveying path 25, which communicates with the reusable used toner conveying path 32 at the merging part 34. The merged toner is then conveyed to the developing device 102 of the image forming apparatus 100 by the toner delivery device 26.

On the other hand, non-reusable used toner (tt) not passed through the sieve, such as coagulated toner having a large particle size, and paper dust not passed through the sieve, are conveyed in a direction indicated by an arrow M into a discarding toner conveying path 33 and then into a discarding toner container 35*a*, which is inserted into the discarding toner container insertion part 35*b* of the collected used toner accommodating device 35. The discarding toner container 35*a* can be removed from the toner supplying device 20 as described earlier for being discarded.

By thus sorting collected used toner into reusable and non-reusable used toner and recycling only reusable used toner, occurrence of abnormal images can be significantly decreased compared with a case where all of collected used toner is recycled. In addition, reusable used toner, which may have been otherwise discarded, may be recycled.

Figure 22:
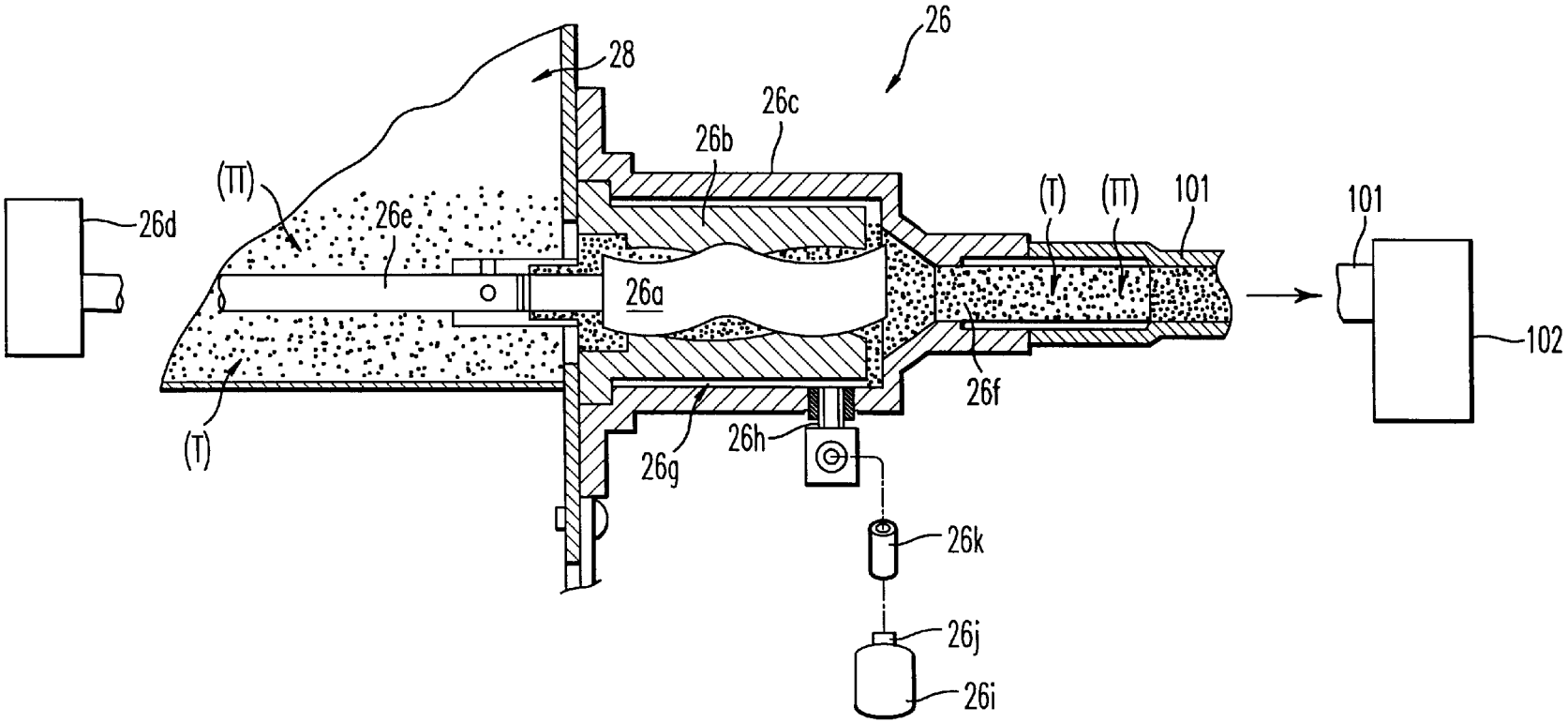
FIG. 22 is a sectional drawing illustrating an exemplary construction of a toner delivery device used in the toner supplying device.

FIG. 22 is a sectional drawing illustrating an exemplary construction of the toner delivery device 26 used in the toner supplying device 20. For the toner delivery device 26, a screw pump which is conventionally known and commonly called a Moineau-pump is used. As illustrated in FIG. 22, the power pump unit 26 includes a rotor 26*a*, a stator 26*b*, and a holder 26*c*.

The rotor 26*a* is engaged with a motor 26*d* as a driving source via a driving shaft of a conveying screw 26*e*, and the rotor 26*a* is rotatively driven by a rotation of the motor 26*d*. The stator 26*b* is made of an elastic body, such as a rubber material, and surrounds the rotor 26*a*. The holder 26*c* holds the stator 26*b*.

The toner delivery device 26 takes in new toner (T) and reusable used toner (TT) at the bottom part of the toner deposit part 28 of the toner supplying device 20 from the side of the driving shaft of the conveying screw 26*e* to deliver the mixed new toner (T) and reusable used toner (TT) toward a toner passageway (i.e., a discharging section) 26*f* with a rotation of the rotor 26*a*. In addition, there is about a 1-mm gap 26*g* between a side of the stator 26*b* and an inner side of the holder 26*c* in communication with the toner passageway 26*f*. An air supply port 26*h* is provided so that air blows from the gap 26*g* to the toner passageway 26*f*. The air supply port 26*h* communicates with the toner passageway 26*f*, and further communicates with an air exhaust outlet 26*j* of an air pump as an air supplying device 26*i* via an air supply tube 26*k*. When the air pump 26*i* starts to run, air blows on the mixed new toner (T) and reusable used toner (TT) in the toner passageway 26*f* via the air supply tube 26*k* and the air supply port 26*h* by approximately 0.5 to 1 liter/minute, whereby fluidization is accelerated for the toner that is discharged from the toner passageway 26*f* of the powder pump unit 26. Thus, the toner is discharged to the toner conveying pipe 101 while being mixed with air. Therefore, toner delivery with the powder pump 26 becomes more reliable.

Figure 23:
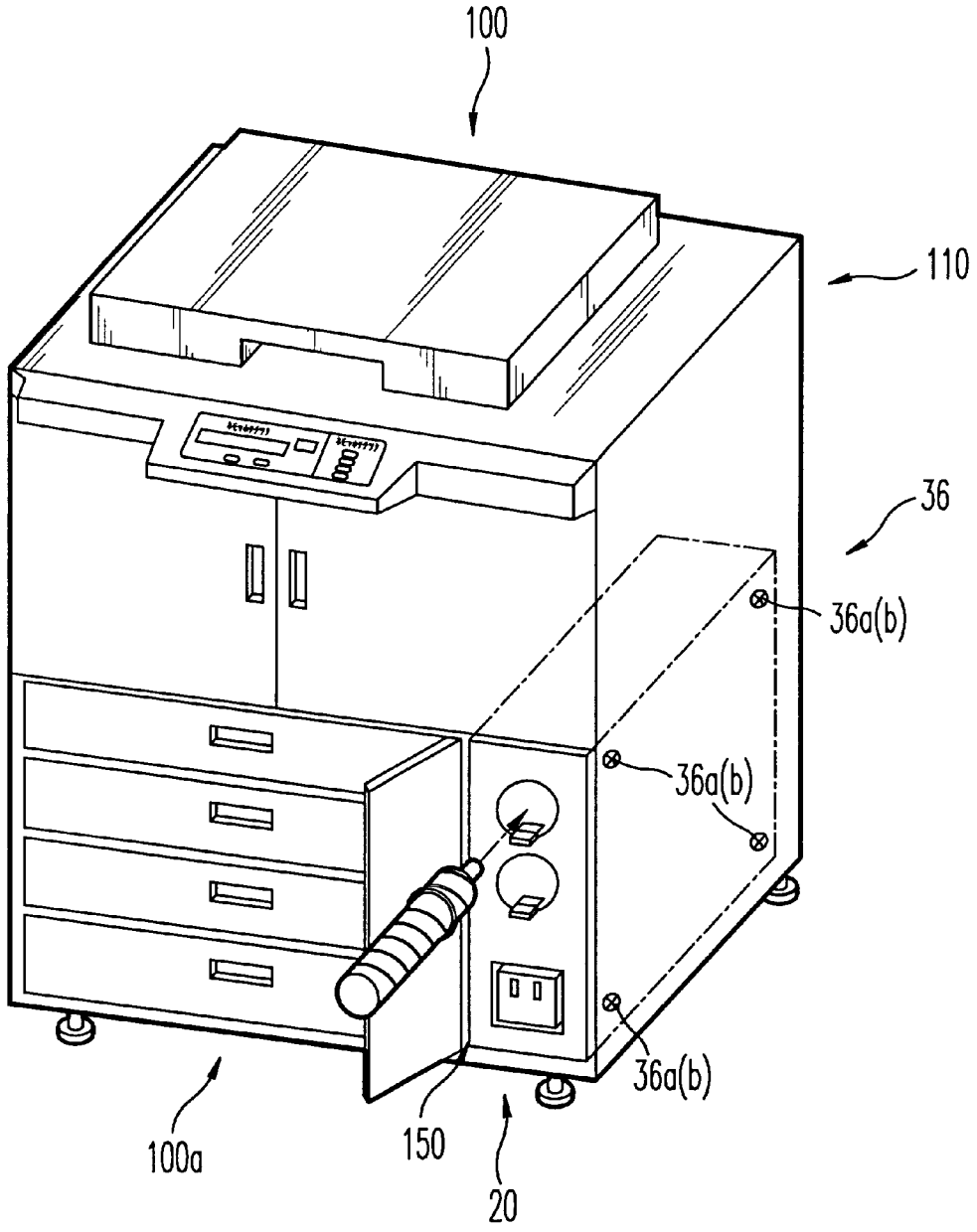
FIG. 23 is a schematic drawing illustrating an appearance of an image forming apparatus including the toner supplying device.
Figure 24:
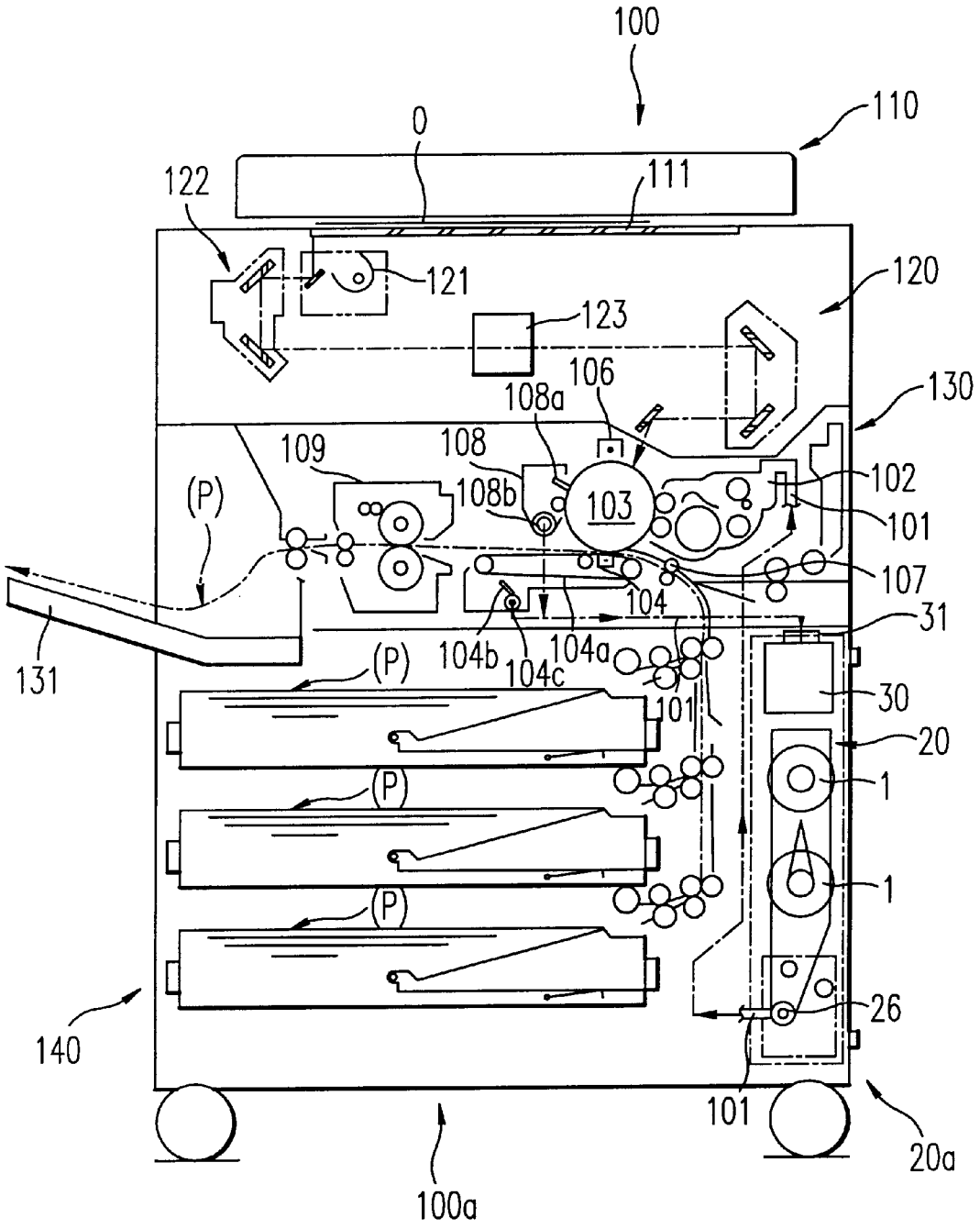
FIG. 24 is a sectional drawing illustrating the construction of the image forming apparatus.

FIG. 23 is a schematic drawing illustrating the appearance of an image forming apparatus 100 including the toner supplying device 20, and FIG. 24 is a sectional drawing illustrating the construction of the image forming apparatus 100.

The image forming apparatus 100 is provided with a toner supplying device attaching part 150 at a lower part of the image forming apparatus 100 in a position apart from the developing device 102 (not shown). The toner supplying device 20 can be inserted into the toner supplying device attaching part 150 from the front surface 100*a* of the image forming apparatus 100. The toner supplying device 20 is detachably attached and fixed to the toner supplying device attaching part 150 by fixing screws 36*a* and fixing parts 36*b* of an attaching device 36.

The image forming device 100 is a copying machine and includes, in addition to the toner supplying device 20, an automatic document feeder (ADF) 110, an exposing section 120 for forming an image in a conventional known electrophotographic system, an image forming section 130, and a paper feeding section 140. The exposing section 120 has an exposure optical system including a light source 121 for putting light on a document O placed on a contact glass 111 by the ADF 110 or with a manual insertion, a series of mirrors 122 and a lens 123 for using a reflected light image from the document to expose a surface of a photosensitive drum 103, which is an image carrier of the image forming section 130.

The image forming section 130 has the photosensitive drum 103 as the image carrier, and a charging device 106, a developing device 102, a resist roller 107, a transfer device 104 and a photosensitive body cleaning device 108, which are arranged around the photosensitive drum 103. Also included is a fixing device 109. A plurality of paper feed cassettes are located in the paper feed section 140 containing transfer paper (P) in various sizes. Although the above exposing section 120 is an example of an analog-type exposure optical system, if it is configured in a system in which an image is optically recorded on the photosensitive drum 103 based on an image signal by using a laser scan optical system in which a laser light source and a deflector are used as an exposing section, the image forming apparatus 100 can serve as a laser printer. Further, the image forming apparatus 100 can also serve as a digital copying machine or a facsimile machine if a document reader is arranged between the ADF 110 and the exposing section 120.

In FIG. 24, when an image forming operation is started, the photosensitive drum 103 is charged by the charging device 106 and then exposed for a document image from the exposing section 120 so that a static latent image is formed on it. The static latent image is developed by developer (e.g., two-component developer or one-component developer) in the developing device 102, and a toner image is formed on the photosensitive drum 103. A toner image formed on the photosensitive drum 103 is transferred to a transfer paper (P) fed to a transfer section (i.e., a nip portion between the photosensitive drum 103 and the transfer belt 104*a* of the transfer device 104) through the resist roller 107 from the paper feed section 140. The transfer paper (P) to which the toner image is transferred is delivered to the fixing device 109 by the transfer belt 104*a* of the transfer device 104, and the toner image is fixed to the transfer paper (P) by the fixing device 109. The transfer paper (P) carrying the fixed toner image is output to a paper output tray 131.

The photosensitive drum 103, after transferring the toner image, is cleaned by the photosensitive body cleaning device 108 to remove and salvage remaining toner and contaminants, such as paper lint. The transfer belt 104*a*, after transfer paper delivery, is also cleaned by a cleaning device 104*b* to remove and salvage remaining toner and paper lint.

In this example, in the developing device 102, a magnetic brush developing method using two-component developer including toner (T) and carrier is applied.

The toner supplying device 20, which is arranged apart from the developing position of the developing device 102, is connected to the developing device 102 via a flexible toner conveying pipe 101 through which toner is conveyed while being mixed with air. Toner (T) stored in each of the toner containers 1 set in the toner supplying device 20 and reusable used toner (TT) sorted by the used toner sorting device 30 are mixed and supplied to the developing device 102 through the toner/air mixture conveying path 101 by the powder pump unit as the toner delivery device 26. As illustrated in FIG. 24, in this embodiment, the powder pump unit as the toner delivery device 26 is arranged in a lower portion of the toner supplying device 20.

For the toner/air mixture conveying pipe 101, it is advantageous to use a material which is flexible and has excellent resistance to toner, such as, for example, nylon, Teflon, etc. In the image forming apparatus 100 in this embodiment, the connection between the developing device 102 and the toner supplying device 20 is flexible, whereby a restriction on each arrangement is dissolved, and therefore it is possible to utilize the layout effectively.

Residual toner remaining on the photoconductive drum 103 is removed by the cleaning blade 108*a* of the cleaning device 108. The removed toner is conveyed by the used toner delivery device 108*b* to the toner supplying device 20 through the toner/air mixture conveying path 101. The conveyed used toner is put into the toner supplying device 20 through the used toner inlet 31.

Residual toner and paper dust on the transfer belt surface 104*a* of the transfer device 104 are also removed by the cleaning blade of the cleaning device 104*b* and are conveyed by the used toner delivery device 104c through the toner/air mixture conveying path 101 into the toner supplying device 20.

Thus, in the above image forming apparatus according to the present invention, toner containers are inserted into a toner supplying device from the side of a front surface of the toner supplying device and thereby the operability of attaching and detaching the toner containers to and from the toner supplying device is improved. Further, with the provision of the toner sorting device that sorts collected used toner into reusable used toner and non-reusable used toner and recycling the re-usable used toner only, coagulation of the toner is prevented. Furthermore, because toner containers 1 containing new toner, a container containing reusable used toner and a container containing non-reusable used toner for discarding are arranged in a same place, i.e., in the toner supplying device, scattering of toner and consequent soiling with scattering toner are effectively prevented.

Obviously, numerous additional modifications and variations of the present invention are possible in light of the above teachings. It is therefore to be understood that within the scope of the appended claims, present invention may be practiced otherwise than as specifically described herein.

This document claims priority and contains subject matter related to Japanese patent applications No. 10-159909 filed in the Japanese Patent Office on May 25, 1998 and No. 10-170613 filed on Jun. 3, 1998, each of which the entire contents are hereby incorporated by reference.

What is claimed is:

1. A toner supplying device for supplying toner contained in a toner container to a developing device of an image forming apparatus, the toner supplying device comprising:

a toner container insertion part configured to receive at least two inserted toner containers from a front side of the toner supplying device;

a toner container holder that detachably holds the at least two toner containers inserted into the toner container insertion part;

a toner container selection control device that selects an arbitrary toner container from among the at least two toner containers held by the toner container holder and causes the selected toner container to discharge toner from an opening thereof while stopping a discharge of toner from an opening of the other toner containers;

a toner conveying path to which said discharged toner is exhausted; and a toner/air mixture delivery device that delivers said exhausted toner to the developing device of the image forming apparatus by mixing the toner with air.

2. The toner supplying device of claim 1, wherein the toner container selection control device causes only the selected toner container to discharge toner from the opening thereof when all of the at least two or more toner containers are in an initial state.

3. The toner supplying device of claim 1, wherein the toner container selection control device continues to operate the toner container which has been started to discharge toner, to discharge toner until the toner container becomes almost empty or empty, while stopping the other toner containers from discharging toner from respective openings.

4. The toner supplying device of claim 1, wherein the toner container selection control device starts to operate another toner container to discharge toner from an opening thereof after the toner container, which has been started to discharge toner, becomes almost empty or empty.

5. The toner supplying device of claim 1, wherein the toner container selection control device stops discharging toner from an opening of the toner container, which has been started to discharge toner, before the toner container becomes almost empty or empty and starts operating another toner container to discharge toner from an opening thereof.

6. The toner supplying device of claim 1, further comprising:

a toner near-end indicating device to indicate that the toner containers are almost empty or empty;

wherein, when all of the at least two toner containers which are held by the toner container holder become almost empty or empty, the toner container selection control device causes the toner near-end indicating device to indicate that the toner containers are almost empty or empty.

7. The toner supplying device of claim 1, further comprising:

a used toner intake inlet to receive used toner, which is collected after having been used for image formation; and a collected used toner accommodating device to accommodate used toner, which is received through the used toner intake inlet.

8. The toner supplying device of claim 7, further comprising a used toner sorting device that sorts the used toner, which is received through the used toner intake inlet, into reusable used toner and non-reusable used toner.

9. The toner supplying device of claim 8, wherein the used toner sorting device is positioned at a side of the opening of the toner containers inserted in the toner container insertion part.

10. The toner supplying device of claim 8, further comprising:

a merging part where said toner conveying path, and a reusable used toner conveying path, to which reusable used toner sorted by the used toner sorting device is exhausted, are merged.

11. The toner supplying device of claim 10, wherein the reusable used toner conveying path is positioned at a side of the opening of the toner containers inserted into the toner container insertion part.

12. The toner supplying device of claim 8, further comprising:

a discarding toner conveying path to which non-reusable used toner, which is sorted by the used toner sorting device, is exhausted.

13. The toner supplying device of claim 12, wherein the discarding toner conveying path is positioned at a side of the opening of the toner containers inserted into the toner container insertion part.

14. The toner supplying device of claim 8, wherein the collected used toner accommodating device includes a discarding toner container, into which the non-reusable used toner is received, and a discarding toner container insertion part, into which the discarding toner container is inserted from the front side of the toner supplying device.

15. The toner supplying device of claim 7, further comprising:

an attaching device to detachably attach the toner supplying device to the image forming device.

16. An image forming apparatus, comprising:

a developing device;

a toner supplying device for supplying toner contained in a toner container to the developing device, the toner supplying device including:

a toner container insertion part configured to receive at least two toner containers from a front side of the toner supplying device;

a toner container holder that detachably holds the toner containers inserted into the toner container insertion part;

a toner container selection control device that selects an arbitrary toner container from among the at least two toner containers held by the toner container holder and causes the selected toner container to discharge toner from an opening thereof while stopping a discharge of toner from an opening of the other toner containers;

a toner conveying path to which said discharged toner is exhausted; and a toner/air mixture delivery device that delivers said exhausted toner to the developing device of the image forming apparatus by mixing the toner with air.

17. The image forming apparatus of claim 16, wherein the toner container selection control device causes only the selected toner container to discharge toner from the opening thereof when all of the at least two toner containers are in an initial state.

18. The image forming apparatus of claim 16, wherein the toner container selection control device continues to operate the toner container which has been started to discharge toner, to discharge toner until the toner container becomes almost empty or empty, while stopping the other toner containers from discharging toner from respective openings.

19. The image forming apparatus of claim 16, wherein the toner container selection control device starts to operate another toner container to discharge toner from an opening thereof after the toner container, which has been started to discharge toner, becomes almost empty or empty.

20. The image forming apparatus of claim 16, wherein the toner container selection control device stops discharging toner from an opening of the toner container, which has been started to discharge toner, before the toner container becomes almost empty or empty and starts operating another toner container to discharge toner from an opening thereof.

21. The image forming apparatus of claim 16, the toner supplying device further including:

a toner near-end indicating device to indicate that the toner containers are almost empty or empty;

wherein, when all of the at least two toner containers, which are held by the toner container holder, become almost empty or empty, the toner container selection control device causes the toner near-end indicating device to indicate that the toner containers are almost empty or empty.

22. The image forming apparatus of claim 16, the toner supplying device further including:

a used toner intake inlet to receive used toner, which is collected after having been used for image formation; and a collected used toner accommodating device to accommodate used toner, which is received through the used toner intake inlet.

23. The image forming apparatus of claim 22, the toner supplying device further including:

a used toner sorting device that sorts the used toner, which is received through the used toner intake inlet, into reusable used toner and non-reusable used toner.

24. The image forming apparatus of claim 23, wherein the used toner sorting device is positioned at a side of the opening of the toner containers inserted in the toner container insertion part.

25. The image forming apparatus of claim 23, the toner supplying device further including:

a merging part where said toner conveying path, and a reusable used toner conveying path, to which reusable used toner sorted by the used toner sorting device is exhausted, are merged.

26. The image forming apparatus of claim 25, wherein the reusable used toner conveying path is positioned at the side of the opening of the toner containers inserted into the toner container insertion part.

27. The image forming apparatus of claim 23, the toner supplying device further including:

discarding toner conveying path to which non-reusable used toner, which is sorted by the used toner sorting device, is exhausted.

28. The image forming apparatus of claim 27, wherein the discarding toner conveying path is positioned at the side of the opening of the toner containers inserted into the toner container insertion part.

29. The image forming apparatus of claim 23, wherein the collected used toner accommodating device includes a discarding toner container, into which the non-reusable used toner is received, and a discarding toner container insertion part, into which the discarding toner container is inserted from the front side of the toner supplying device.

30. The image forming apparatus of claim 16, further comprising:

an attaching device to detachably attach the toner supplying device to the image forming device.

31. The image forming apparatus of claim 16, further comprising:

toner near-end indicating device that indicates that the toner containers in the toner supplying device are almost empty or empty when all of the at least two toner containers, which are held by the toner container holder, become almost empty or empty.

32. The image forming apparatus of claim 16, wherein the toner supplying device is positioned at a lower part of the image forming apparatus.

33. A method of supplying toner contained in a toner container of a toner supplying device to a developing device of an image forming apparatus, the method comprising steps of:

attaching at least two toner containers to the toner supplying device;

selecting an arbitrary toner container from among the at least two toner containers and causing the selected toner container to discharge toner from an opening thereof while stopping a discharge of toner from an opening of the other toner containers; and delivering the discharged toner to the developing device of the image forming apparatus by mixing the toner with air.

34. The toner supplying method of claim 33, wherein all of the at least two toner containers are in an initial state of an initial operation in the attaching step.

35. The toner supplying method of claim 33, wherein the toner container, which has been started to discharge toner, discharges toner until the toner container becomes almost empty or empty, while stopping the other toner containers from discharging toner from respective openings, in the discharging step.

36. The toner supplying method of claim 33, wherein at least one of the other toner containers starts to discharge toner from an opening thereof after the toner container, which has been started to discharge toner, becomes almost empty or empty, in the discharging step.

37. The toner supplying method of claim 33, wherein discharging toner from an opening of the toner container, which has been started to discharge toner, is stopped before the toner container becomes almost empty or empty and starts operating another toner container to discharge toner from an opening thereof, in the discharging step.

38. The toner supplying method of claim 33, wherein, when all of the at least two toner containers become almost empty or empty, an indication indicates that the toner containers are almost empty or empty, in the discharging step.

39. The toner supplying method of claim 33, further comprising a step of:

receiving used toner, which is collected after having been used for image formation, into the toner supplying device.

40. The toner supplying method of claim 39, further comprising a step of:

sorting the received used toner into reusable used toner and non-reusable used toner.

41. The toner supplying method of claim 40, further comprising a step of:

merging the toner discharged from the toner containers and the reusable used toner.

42. The toner supplying method of claim 40, further comprising a step of exhausting the non-reusable used toner.

43. A method of forming an image in an image forming apparatus, comprising the steps of:

attaching at least two toner containers to a toner supplying device;

forming a latent image on a photoconductor;

selecting an arbitrary toner container from at least two toner containers attached to a toner supplying device and causing the selected toner container to discharge toner from an opening thereof while stopping a discharge of toner from an opening of the other toner containers;

delivering the discharged toner to a developing device by mixing the toner with air; and developing the latent image with the delivered toner to form a toner image.

44. The image forming method of claim 43, wherein all of the at least two toner containers are in an initial state in the attaching step.

45. The image forming method of claim 43, wherein the toner container, which has been started to discharge toner, discharges toner until the toner container becomes almost empty or empty, while stopping the other toner containers from discharging toner from respective openings, in the discharging step.

46. The image forming method of claim 43, wherein at least one of the other toner containers starts to discharge toner from an opening thereof after the toner container, which has been started to discharge toner, becomes almost empty or empty, in the discharging step.

47. The image forming method of claim 43, wherein discharging toner from an opening of the toner container, which has been started to discharge toner, is stopped before the toner container becomes almost empty or empty and starts operating another toner container to discharge toner from an opening thereof, in the discharging step.

48. The image forming method of claim 43, wherein, when all of the at least two toner containers become almost empty or empty, an indication indicates that the toner containers are almost empty or empty, in the discharging step.

49. The image forming method of claim 43, further comprising a step of:

receiving used toner, which is collected after having been used for image formation, into the toner supplying device.

50. The image forming method of claim 49, further comprising a step of:

sorting the received used toner into reusable used toner and non-reusable used toner.

51. The image forming method of claim 50, further comprising a step of:

merging the toner discharged from the toner container and the reusable used toiler.

52. The image forming method of claim 50, further comprising a step of exhausting the non-reusable used toner.

53. The image forming method of claim 43, further comprising a step of:

indicating that the toner containers in the toner supplying device are almost empty or empty when all of the at least two toner containers become almost empty or empty.

* * * * *